US006749540B1

(12) United States Patent
Pasero et al.

(10) Patent No.: US 6,749,540 B1
(45) **Date of Patent: *Jun. 15, 2004**

(54) CROSS TRAINING EXERCISE DEVICE

(75) Inventors: Peter Pasero, Renton, WA (US); Paul D. Barker, Woodinville, WA (US); Janine Whan-Tong, Woodinville, WA (US)

(73) Assignee: Precor Incorporated, Woodinville, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/382,555

(22) Filed: Aug. 25, 1999

Related U.S. Application Data

(63) Continuation of application No. 08/967,801, filed on Nov. 10, 1997, which is a continuation-in-part of application No. 08/670,515, filed on Jun. 27, 1996, now Pat. No. 5,685,804, which is a continuation-in-part of application No. 08/568,499, filed on Dec. 7, 1995, now abandoned.

(51) Int. Cl.[7] ..... A63B 69/16; A63B 22/00
(52) U.S. Cl. ..... 482/52; 482/57
(58) Field of Search ..... 482/51–53, 57, 482/70, 79, 80

(56) References Cited

U.S. PATENT DOCUMENTS

| | | | | |
|---|---|---|---|---|
| 5,779,598 | A | | 7/1998 | Lee |
| D405,852 | S | | 2/1999 | McBride |
| 5,916,065 | A | | 6/1999 | McBride et al. |
| 6,063,008 | A | | 5/2000 | McBride et al. |
| 6,146,313 | A | * | 11/2000 | Whan-Tong et al. ..... 482/52 |

* cited by examiner

*Primary Examiner*—Stephen R. Crow
(74) *Attorney, Agent, or Firm*—Christensen O'Connor Johnson Kindness PLLC

(57) ABSTRACT

An exercise device includes a pair of foot engaging links (30*a*, 30*b*). The rearward ends of the foot links are supported to travel back and forth on rollers 32*ac* and 32*bc*. The combination of these two foot link motions permits the users feet to travel along an elliptical path of travel. The inclination of the foot links may be selectively altered to vary the nature of the stepping motion experienced by the user. At flatter inclinations of the foot links, the stepping motion may resemble cross country skiing. At progressively greater angles of inclination of the foot links, the stepping motions may simulate walking, jogging, running and climbing.

26 Claims, 22 Drawing Sheets

CROSS TRAINING EXERCISE DEVICE

CROSS-REFERENCE TO RELATED APPLICATIONS

The present aplication is a continuation of co-pending application Ser. No. 08/967,801 field Nov. 10, 1997, which in turn is a continuation-in-part of application Ser. No. 08/670,515 filed Jun. 27, 1996, now U.S. Pat. No. 5,685,804, which in turn is a continuation-in-part of application Ser. No. 08/568,499 filed on Dec. 7, 1995 now abandoned.

FIELD OF THE INVENTION

The present invention relates to exercise equipment, and more specifically to a stationary exercise device for simulating a range of stepping motions, including skiing, walking, jogging, running and climbing.

BACKGROUND OF THE INVENTION

The benefits of regular aerobic exercise has been well established and accepted. Because of inclement weather, time constraints and for other reasons, it is not possible to always walk, jog or run outdoors or swim in a pool. As such, various types of exercise equipment have been developed for aerobic exercise. For example, cross country skiing exercise devices simulate the gliding motion of cross country skiing. Such machines provide a good range of motion for the muscles of the legs. Treadmills are also utilized by many people for walking, jogging or even running. One drawback of most treadmills is that during jogging or running, significant jarring of the hip, knee, ankle and other joints of the body may occur. Another type of exercise device simulates stair climbing. Such devices can be composed of foot levers that are pivotally mounted to a frame at their forward ends and have foot receiving pads at their rearward ends. The user pushes his/her feet down against the foot levers to simulate stair climbing. Resistance to the downward movement of the foot levers is provided by springs, fluid shock absorbers and/or other elements.

The aforementioned devices exercise different muscles of the user's legs and other parts of the body. Thus, to exercise all of these muscles, three separate exercise apparatus are needed. This not only may be cost prohibitive, but also many people do not have enough physical space for all of this equipment. Further, if only one of the foregoing exercise apparatus is purchased by a user, the user may tire of always utilizing the singular equipment and may desire to use other types of equipment.

Through the present invention, a singular piece of equipment may be utilized to simulate different exercise apparatus, including cross country skiing, walking, jogging, running and climbing. Further, jogging and running are simulated without imparting shock to the user's body joints in the manner of exercise treadmills.

These and other advantages of the present invention will be readily apparent from the drawings, discussion and description which follow.

SUMMARY OF THE INVENTION

The exercise device of the present invention utilizes a frame configured to be supported on a floor. The frame defines a rearward pivot axis about which first and second foot links are coupled to travel along an arcuate path relative to the pivot axis. The foot links, adapted to support the user's feet, have forward ends that are engaged with a guide mounted on the frame to enable the forward ends of the foot links to travel back and forth along a defined path. The angular elevation of the guide and/or the elevation of the guide relative to the frame may be selectively changed to alter the path traveled by the foot supporting portion of the first and second links thereby to simulate various types of stepping motion.

In a more specific aspect of the present invention, the guide includes rails for receiving and guiding the forward ends of the foot links. The rails may be raised and lowered relative to the frame. For example, the guides may be pivotally mounted on the frame, and the angle of inclination of the guides may be selectively altered.

In a yet more specific aspect of the present invention, the guides may be in the form of tracks that engage with the forward ends of the foot links. The elevation and/or angular orientation of the tracks relative to the frame may be selectively changed thereby to alter the types of stepping motion experienced by the user.

In another aspect of the present invention, the guide for the forward ends of the foot links may include one or more pivot or rocker arms pivotally supported by the frame, with the lower ends of the rocker arms pivotally connected to the forward ends of the foot links. The lengths of the rocker arms may be lengthened or shortened thereby to raise and lower the connection point between the rocker arms and the forward ends of the foot links, thereby to change the type of stepping motion experienced by the user.

In a further aspect of the present invention, flywheels are mounted on a rearward portion of the frame to rotate about the frame pivot axis. The rearward ends of the foot links are pivotally pinned to the flywheels at a selective location from the frame pivot axis. The flywheel serves not only as the coupling means between the rearward ends of the foot links and the frame pivot axis, but also as a momentum storing device to simulate the momentum of the body during various stepping motions.

According to a further aspect of the present invention, resistance may be applied to the rotation of the flywheels, to make the stepping motion harder or easier to achieve. This resistance may be coordinated with the workout level desired by the user, for instance, a desired heart rate range for optimum caloric expenditure. A heart rate monitor or other sensor may be utilized to sense the desired physical parameter to be optimized during exercise.

In a still further aspect of the present invention, the rearward end of the foot links are connected to the pivot axis by a connection system that allows relative pivoting motion between the pivot axis and foot links about two axes, both orthogonal (transverse) to the length of the foot links. As such, the forward ends of the foot links are free to move or shift relative to the rearward ends of the foot links in the sideways direction, i.e., traverse to the length of the foot links.

In another aspect of the present invention, the forward ends of the foot links may be supported by rollers mounted on the frame. The rollers may be adapted to be raised and lowered relative to the frame thereby to alter the inclination of the foot links, and thus, the types of foot motion experienced by the user.

In still further aspects of the present invention, the inclination of the foot links may be altered by other techniques thereby to selectively change the types of foot motion experienced by the user. For instance, the forward end of the frame may be raised and lowered relative to the floor. Alternatively, the rearward pivot axis may be raised and lowered relative to the floor. Still alternatively, a pair of downwardly depending pivot arms may be used to support the forward ends of the foot links. In this regard, the upper end of one of the pivot arms is pinned to the forward end of a foot link at one location and the upper end of the second pivot arm is connectable to the forward end of the foot link at various locations therealong. The lower ends of both of the arms are coupled together to a roller that rides on the frame just above the floor as the foot links move fore and aft during operation of the apparatus. By adjusting the location of the upper end of the movable arm along the foot link, the elevation of the forward end of the foot link may be altered relative to the frame.

BRIEF DESCRIPTION OF THE DRAWINGS

The foregoing aspects and many of the advantages of the present invention will be more readily appreciated as the same becomes better understood by reference to the following detailed description, when taken in conjunction with the accompanying drawings, wherein.

DETAILED DESCRIPTION OF THE PREFERRED EMBODIMENT

Figure 1:
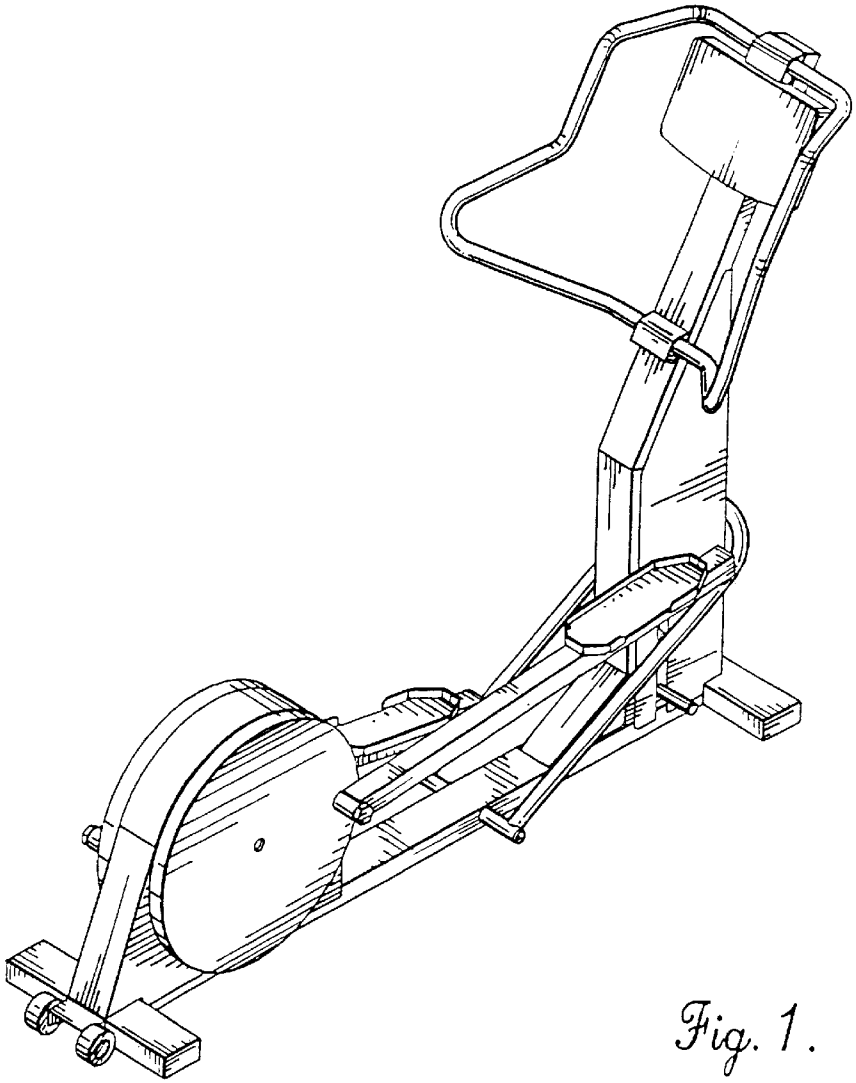
FIG. 1 is a perspective view of an exercise apparatus of the present invention looking from the rear toward the front of the apparatus.
Figure 3:
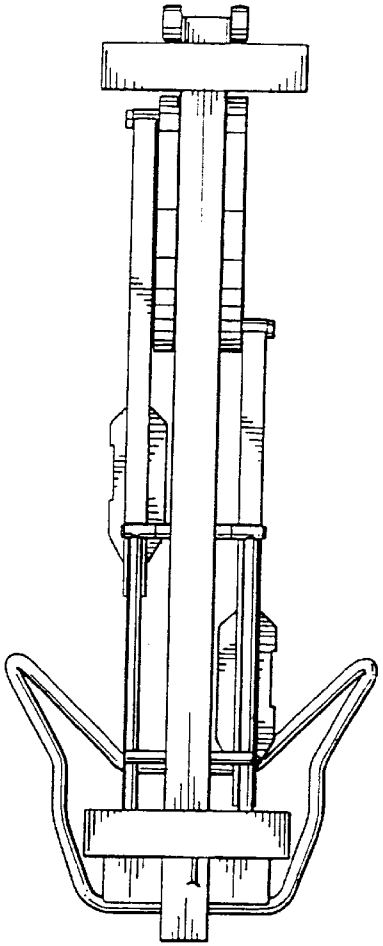
FIG. 3 is a bottom view of the apparatus of FIG. 1.
Figure 2:
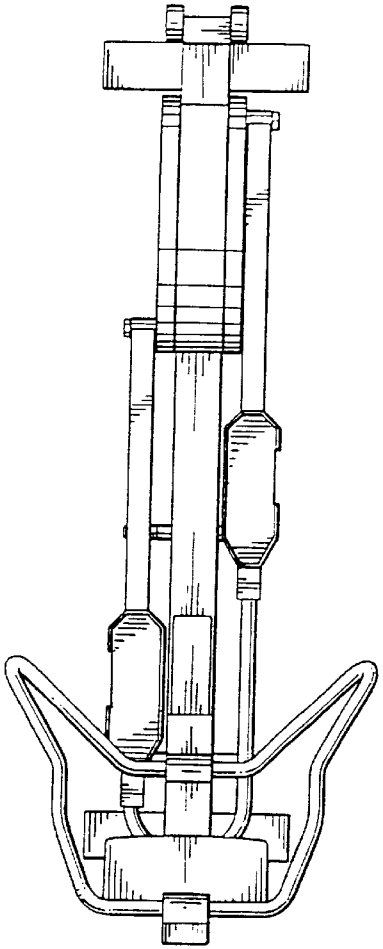
FIG. 2 is a top view of the apparatus of FIG. 1.
Figure 5:
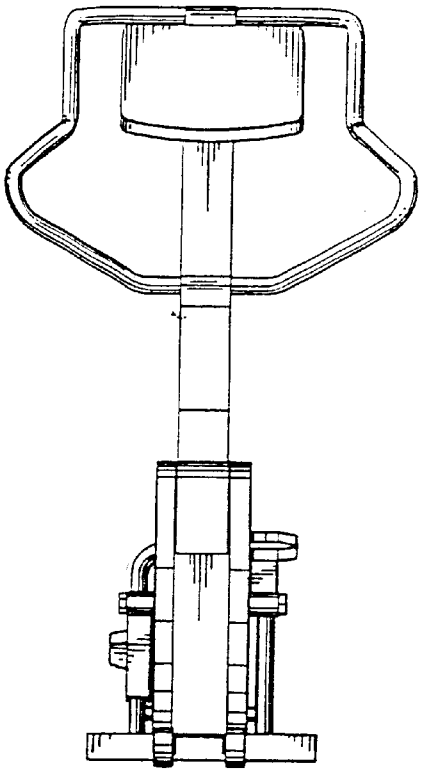
FIG. 5 is a rear view of the apparatus of FIG. 1.
Figure 4:
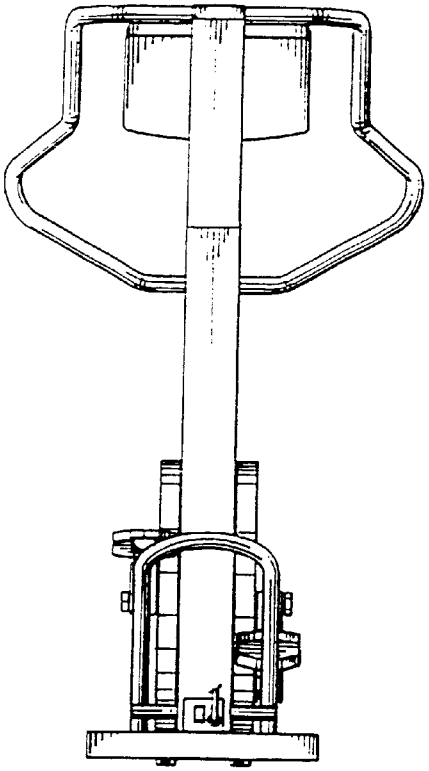
FIG. 4 is a front view of the apparatus of FIG. 1.
Figure 6:
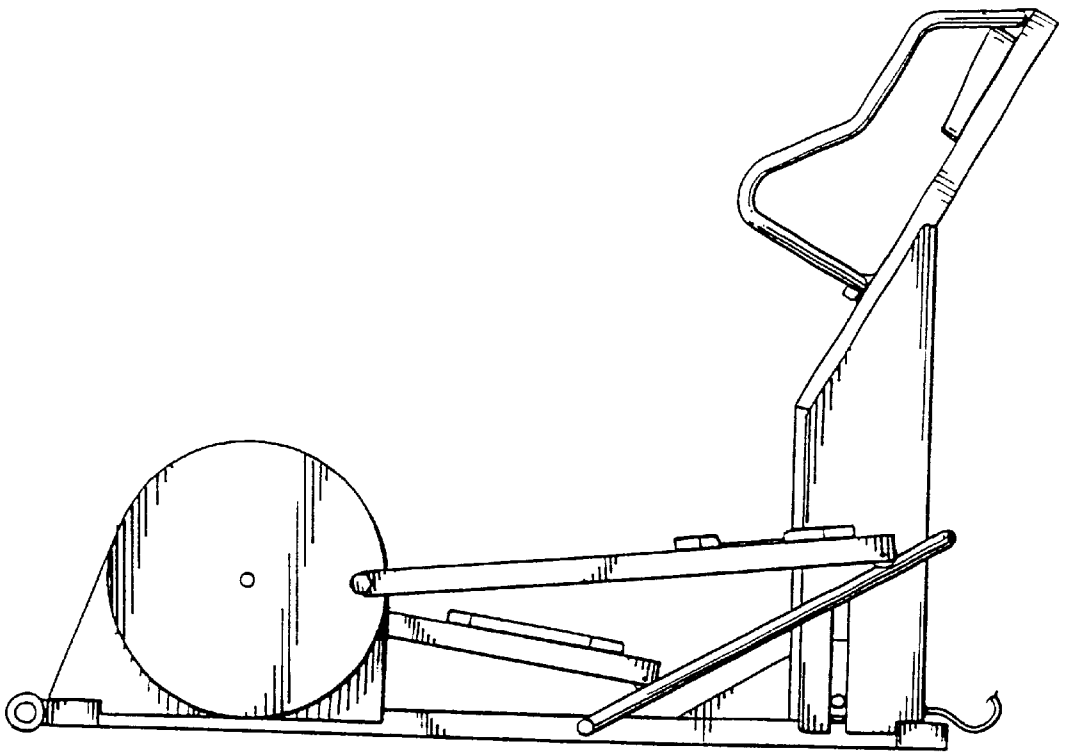
FIG. 6 is side elevational view of the apparatus of FIG. 1.
Figure 7:
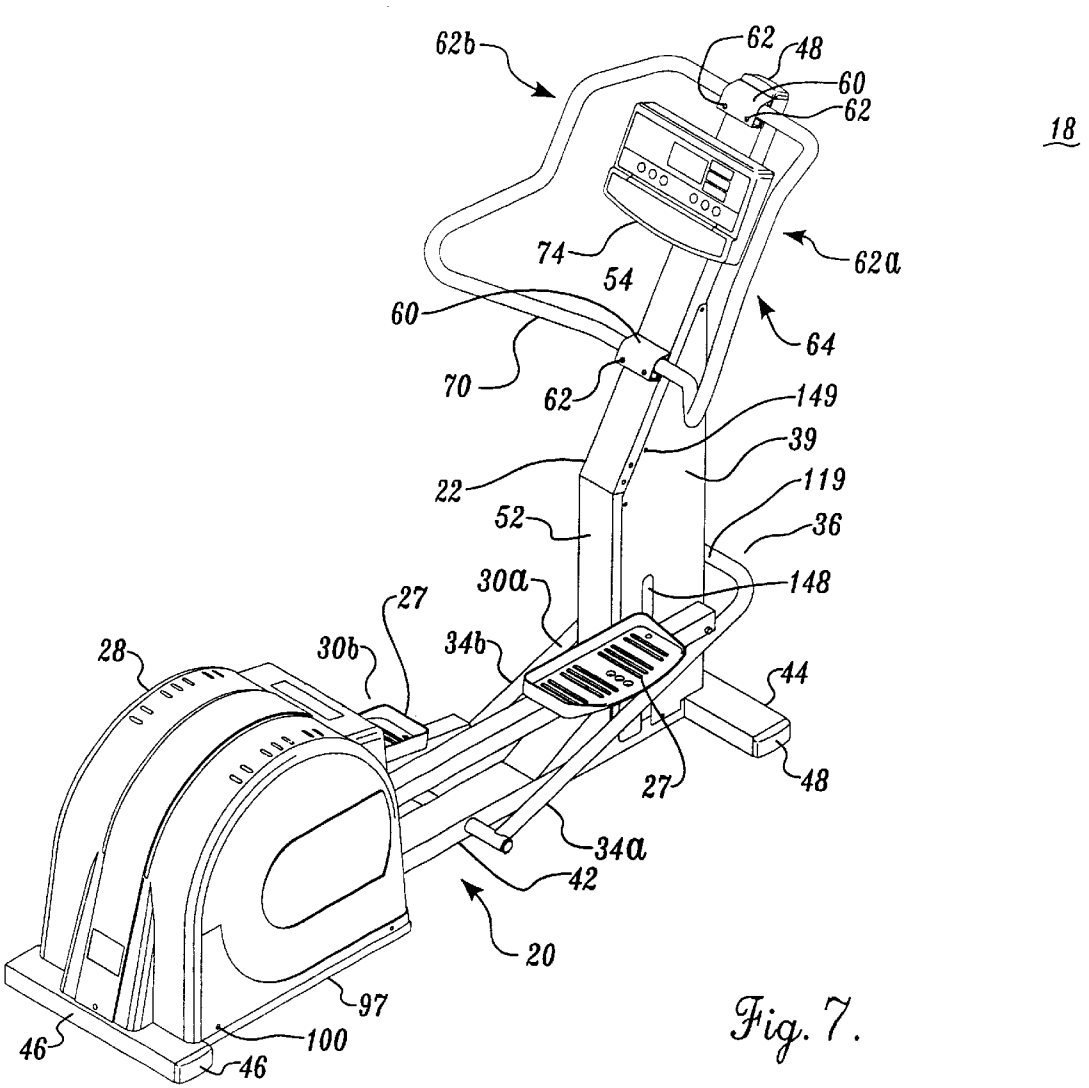
FIG. 7 is a perspective view of the apparatus of FIG. 1, wherein a hood has been installed over the rear portion of the apparatus, this perspective view looks from the rear of the apparatus towards the front.
Figure 8:
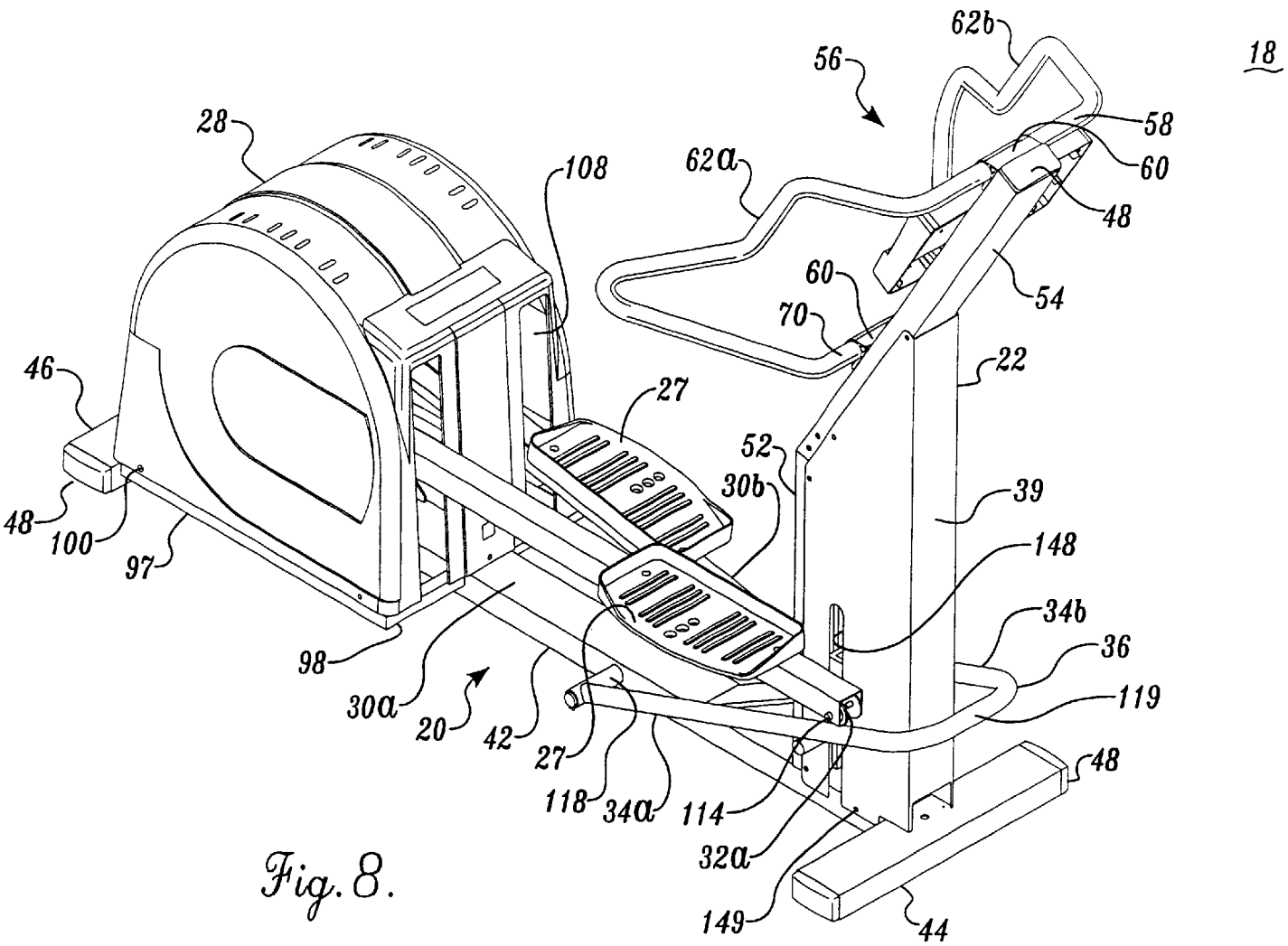
FIG. 8 is a view similar to FIG. 7, but looking from the front of the apparatus towards the rear.

Referring initially to FIGS. 1–9, the apparatus 18 of the present invention includes a floor engaging frame 20 incorporating a forward post 22 extending initially upwardly and then diagonally forwardly. A pair of flywheels 24*a* and 24*b* are located at the rear of the frame 20 for rotation about a horizontal, transverse axis 26. The flywheels 24*a* and 24*b* may be covered by a rear hood 28. The rearward ends of foot links 30*a* and 30*b* are pivotally attached to corresponding flywheels 24*a* and 24*b* to travel about a circular path around axis 26 as the flywheels rotate. Rollers 32*a* and 32*b* are rotatably mounted to the forward ends of foot links 30*a* and 30*b* to ride along corresponding tubular tracks 34*a* and 34*b* of a guide 36. The forward ends of the foot links 30*a* and 30*b* reciprocate back and forth along tracks 34*a* and 34*b* as the rearward ends of the foot links rotate about axis 26 causing the foot pedals or pads 27 carried by the foot links to travel along various elliptical paths, as described more fully below.

A lift mechanism 38, mounted on the post 22, is operable to selectively change the inclination of the guide 36 thereby to alter the stepping motion of the user of the apparatus of the present invention. At a low angle of inclination, the apparatus provides a cross country skiing motion and as the angle of inclination progressively rises, the motion changes from walking to running to climbing. A forward hood 39 substantially encases the lift mechanisms.

Figure 11:
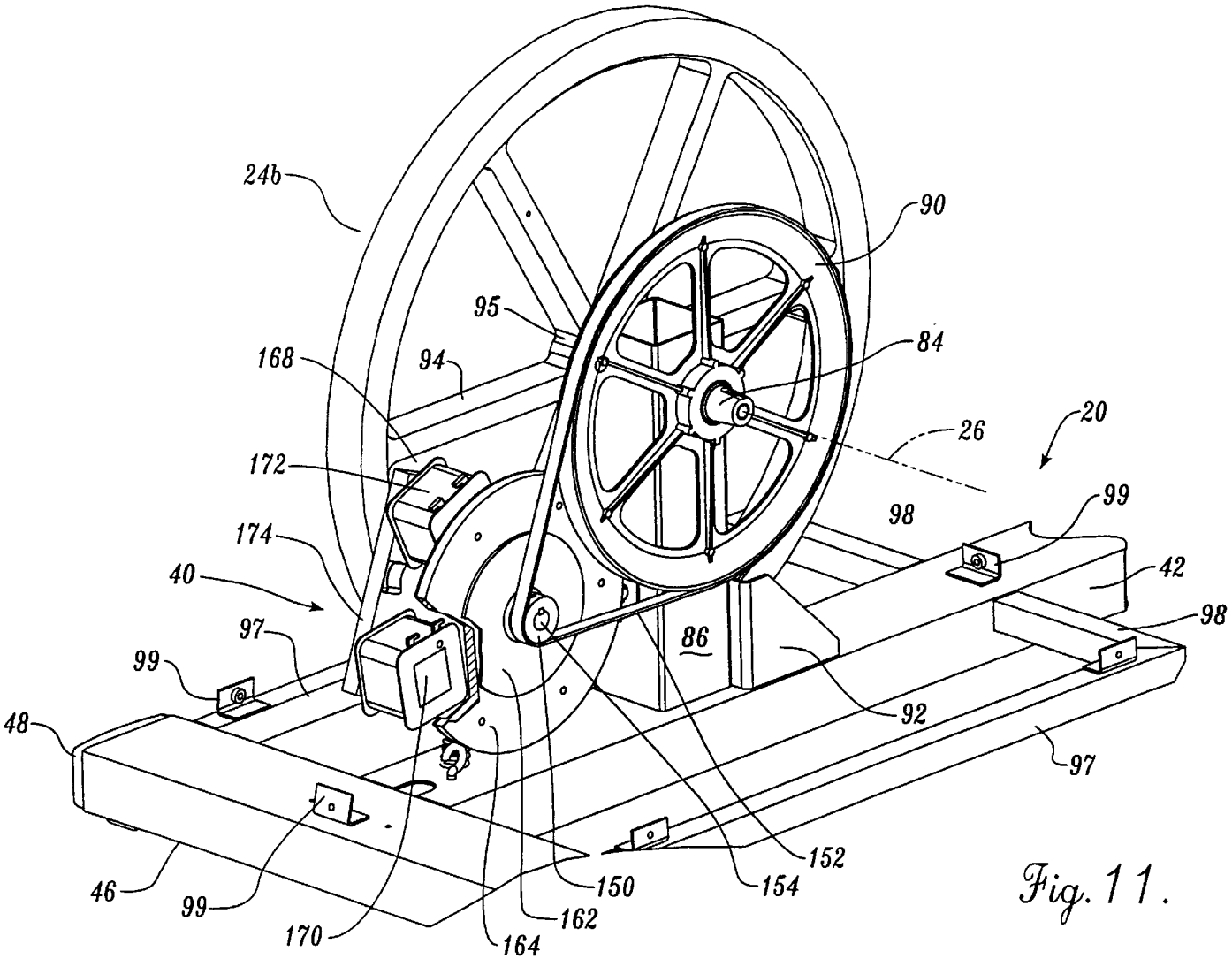
FIG. 11 is an enlarged, fragmentary, rear perspective view of the apparatus shown in FIG. 9, with one of the flywheels removed.
Figure 12:
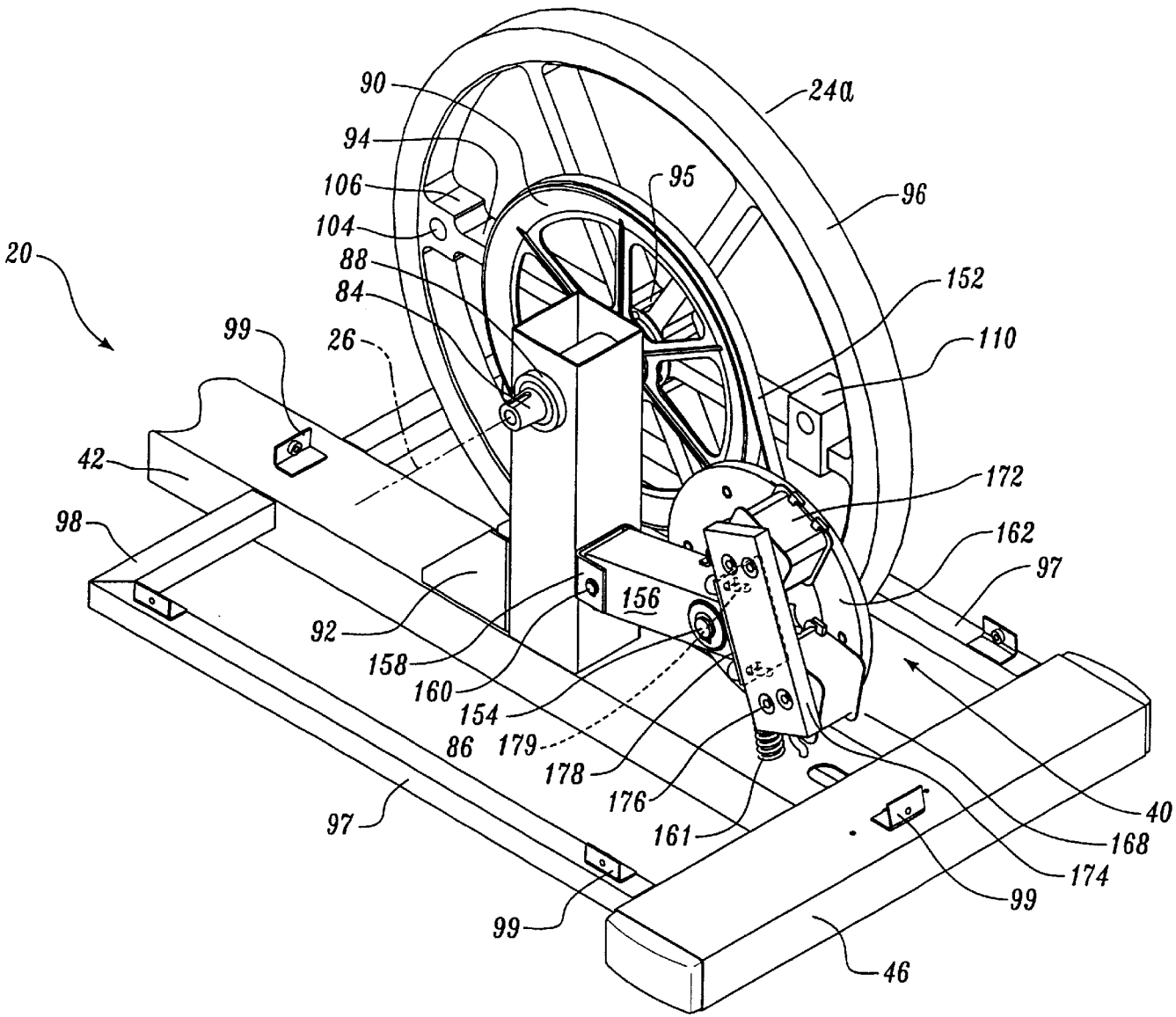
FIG. 12 is a view similar to FIG. 11, but from the opposite side of the apparatus and with the near flywheel removed.

In addition, as most clearly shown in FIGS. 11 and 12, the present invention employs a braking system 40 for imparting a desired level of resistance to the rotation of flywheels 24*a* and 24*b*, and thus, the level of effort required of the user of apparatus 18. The following description describes the foregoing and other aspects of the present invention in greater detail.

Frame 20 is illustrated as including a longitudinal central member 42 terminating at front and rear relatively shorter transverse members 44 and 46. Ideally, but not essentially, the frame 20 is composed of rectangular tubular members, which are relatively light in weight but provide substantial strength. End caps 48 are engaged within the open ends of the transverse members 44 and 46 to close off the ends of these members.

The post structure 22 includes a lower, substantially vertical section 52 and an upper section 54 that extends diagonally upwardly and forwardly from the lower section. Ideally, but not essentially, the post lower and upper sections 52 and 54 may also be composed of rectangular tubular material. An end cap 48 also engages within the upper end of the post upper section 54 to close off the opening therein.

A continuous, closed form handle bar 56 is mounted on the upper portion of post upper section 54 for grasping by an individual while utilizing the present apparatus 18. The handle bar includes an upper transverse section 58 which is securely attached to the upper end of the post upper section 54 by a clamp 60 engaging around the handle bar upper section and securable to the post upper section by a pair of fasteners 62. The handle bar also includes side sections 62*a* and 62*b* each composed of an upper diagonally disposed section, an intermediate, substantially vertical section and lower diagonally disposed sections 68*a* and 68*b* extending downwardly and flaring outwardly from the intermediate side sections. The handle bar 56 also includes a transverse lower section 70 having a central portion clamped to post upper section 54 by a clamp 60, which is held in place by a pair of fasteners 62. Although not shown, the handle bar 56 may be in part or in whole covered by a gripping material or surface, such as tape, foamed synthetic rubber, etc.

A display panel 74 is mounted on the post bar upper section 54 at a location between the upper and lower transverse sections 58 and 70 of the handle bar 56. The display panel includes a central display screen 76 and several smaller screens 78 as well as a keypad composed of a number of depressible "buttons" 80, as discussed in greater detail below.

The flywheels 24*a* and 24*b* are mounted on the outboard, opposite ends of a drive shaft 84 rotatably extending transversely through the upper end of a rear post 86 extending upwardly from a rear portion of the frame central member 42. A bearing assembly 88 is employed to anti-frictionally mount the drive shaft 84 on the rear post 86. In a preferred embodiment of the present invention, the flywheels 24*a* and 24*b* are keyed or otherwise attached to the drive shaft 84 so that the flywheels rotate in unison with the drive shaft. It will be appreciated that the center of the drive shaft 84 corresponds with the location of transverse axis 26. A belt drive sheave 90 is also mounted on drive shaft 84 between flywheel 24*a* and the adjacent side of rear post 86.

The rear post 86 may be fixedly attached to frame longitudinal member 42 by any expedient manner, such as by welding or bolting. In accordance with a preferred embodiment of the present invention, a corner type brace 92 is employed at the juncture of the forward lower section of rear post 86 with the upper surface of longitudinal member 42 to provide reinforcement therebetween. Of course, other types of bracing or reinforcement may be utilized.

The flywheels 24*a* and 24*b* are illustrated as incorporating spokes 94 that radiate outwardly from a central hub 95 to intersect a circumferential rim 96. The flywheels 24*a* and 24*b* may be of other constructions, for instance, in the form of a substantially solid disk, without departing from the spirit or scope of the present invention.

The rear hood 28 encloses the flywheels 24*a* and 24*b*, the brake system 40 and the rear portions of the foot links 30*a* and 30*b*. The hood 28 rests on frame rear transverse member 46 as well as on a pair of auxiliary longitudinal members 97 extending forwardly from the transverse member 46 to intersect the outward ends of auxiliary intermediate transverse members 98. The upper surfaces of the hood support members 97 and 98 coincide with the upper surfaces of frame member 42 and 46. Also, a plurality of attachment brackets 99 are mounted on the upper surfaces of the auxiliary support members 97 and 98 as well as frame members 42 and 46. Threaded openings are formed in the brackets 99 to receive fasteners used to attach the hood 28 thereto. As most clearly illustrated in FIGS. 11 and 12, ideally in cross section the heights of hood support members 97 and 98 are shorter than the cross-sectional height of frame members 42 and 46 so as not to bear on the underlying floor.

The foot links 30*a* and 30*b* as illustrated are composed of elongate tubular members but can be of other types of construction, for example, solid rods. The rear ends of the foot links 30*a* and 30*b* pivotally pinned to outer perimeter portions of flywheels 24*a* and 24*b* by fasteners 100 that extend through collars 102 formed at the rear ends of the foot links to engage within apertures 104 formed in perimeter portions of the flywheels. As most clearly shown in FIG. 12, the aperture 104 is located at the juncture between flywheel spoke 94 and the outer rim 96. This portion of the flywheel has been enlarged to form a boss 106. The foot links 30*a* and 30*b* extend outwardly of the front side of hood 28 through vertical openings 108 formed in the front wall of the hood.

As also shown in FIG. 12, a second boss 110 is formed on the diametrically opposite spoke to the spoke on which boss 106 is located, but at a location closer to axis 26 than the location boss 106. The collars 102 at the rear ends of the foot links may be attached to the flywheels at bosses 110 instead of bosses 106, thereby reducing the diameter of the circumferential paths traveled by the rear ends of the foot links during rotation of the flywheel, and thus, correspondingly shortening the length of the elliptical path circumscribed by the foot pedals 27. It will be appreciated that attaching the collars 102 to bosses 110 results in a shorter stroke of the foot links, and thus, a shorter stride taken by the exerciser in comparison to the stride required when the collars are attached to the flywheels at bosses 106.

Concave rollers 32*a* and 32*b* are rotatably joined to the forward ends of the foot links 30*a* and 30*b* by cross shafts 114. The concave curvature of the rollers coincide with the diameter of the tracks 34*a* and 34*b* of the guide 36. As such, the rollers 32*a* and 32*b* maintain the forward ends of the foot links securely engaged with the guide 36 during use of the present apparatus. Foot receiving pedals 27 are mounted on the upper surfaces of the foot links 30 to receive and retain the user's foot. The pedals 27 are illustrated as formed with a plurality of transverse ridges that not only enhance the structural integrity of the foot pads, but also serve an anti-skid function between the bottom of the user's shoe or foot and the foot pedals. Although not shown, the foot pedals may be designed to be positionable along the length of the foot links to accommodate user's of different heights and in particular different leg lengths or in seams.

The guide 36 is illustrated as generally U-shaped with its rearward, free ends pivotally pinned to an intermediate location along the length of frame central member 42. The free ends of the guide 36 may be pivotally attached to the central frame member 42 by any convenient method, including by being journaled over the outer ends of a cross tube 118. The guide is composed of parallel, tubular tracks 34*a* and 34*b* disposed in alignment with the foot links 30*a* and 30*b*. The forward ends of the tracks 34*a* and 34*b* are joined together by an arcuate portion 119 that crosses the post 22 forwardly thereof.

Figure 9:
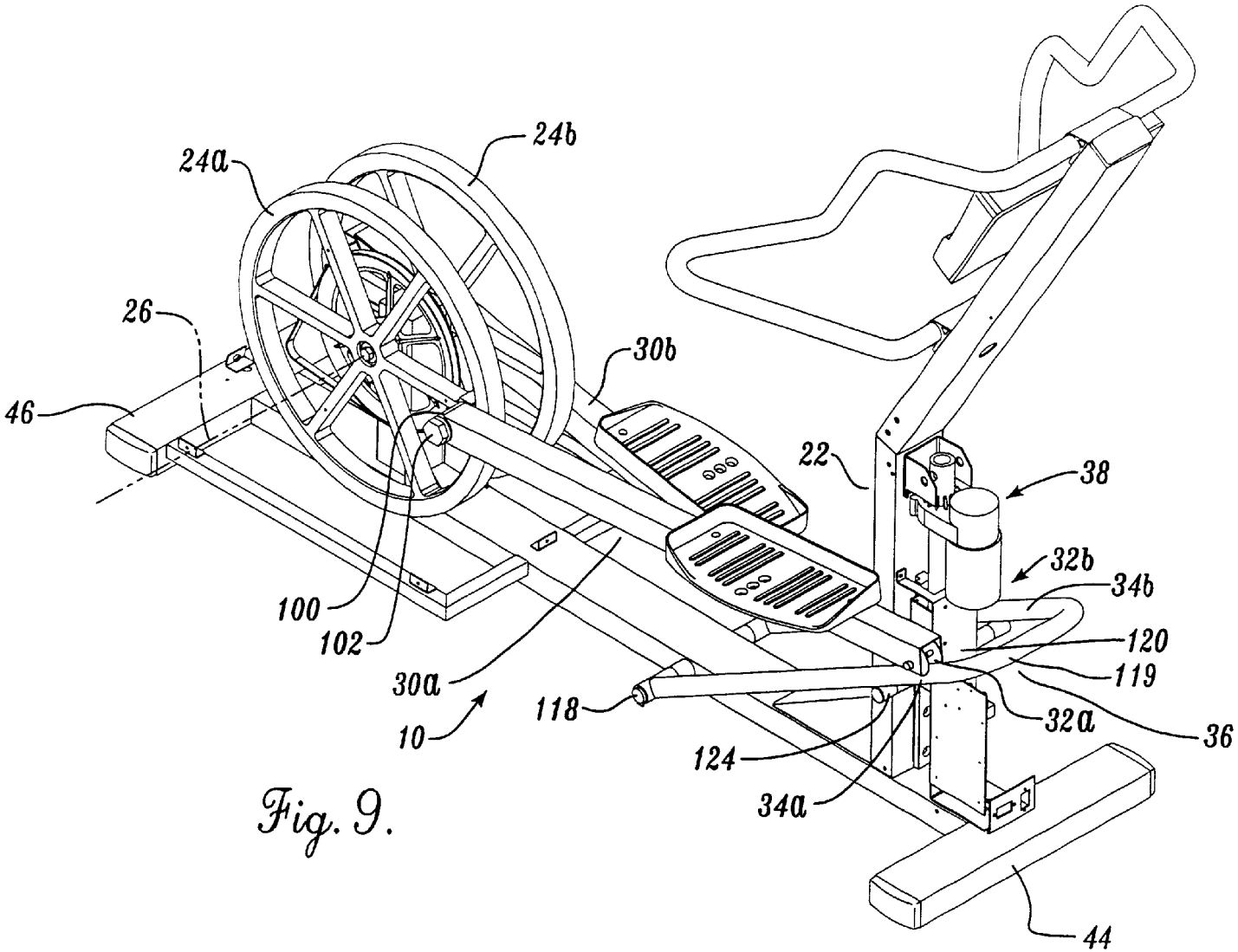
FIG. 9 is a view similar to FIG. 8, but with the front and rear hoods removed.
Figure 10:
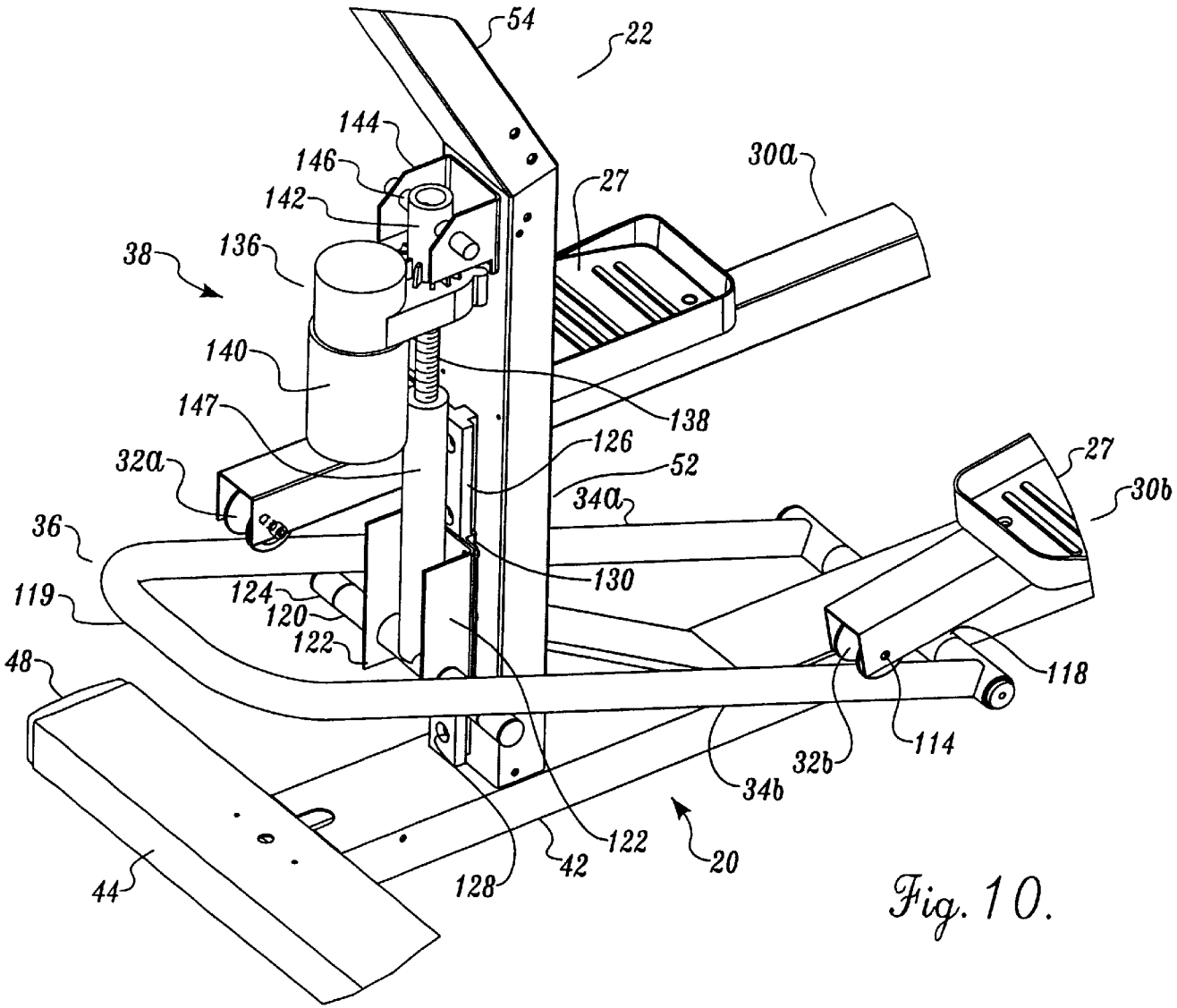
FIG. 10 is an enlarged, fragmentary, perspective view of the forward portion of the apparatus shown in FIG. 9.

The forward portion of the guide 36 is supported by lift mechanism 38, which is most clearly shown in FIGS. 9 and 10. The lift mechanism 38 includes a crossbar 120 supported by the lower end of a generally U-shaped, vertically movable carriage 122. Roller tube sections 124 are engaged over the outer ends of the crossbar 120 to directly underlie and bear against the bottoms of tracks 34*a* and 34*b*. The carriage 122 is restrained to travel vertically along the height of a central guide bar 126 which is securely fastened to the forward face of the post lower section 54 by any appropriate method, such as by fasteners 128. In cross section, the guide bar 126 is generally T-shaped, having a central web portion that bears against the post lower section 52 and transversely extending flange portions that are spaced forwardly of the post lower section. A pair of generally Z-shaped retention brackets 130 retain the carriage 122 in engagement with the guide bar 126. The retention brackets each include a first transverse flange section mounted to the back flange surface of the carriage, an intermediate web section extending along the outer side edges of the guide bar flanges and a second transverse flange section disposed within the gap formed by the front surface of the post lower section 52 and the opposite surface of the guide bar flange. It will be appreciated that by this construction the carriage 122 is allowed to vertically travel relative to the guide bar 126 but is retained in engagement with the guide bar.

The carriage 122 is raised and lowered by an electrically powered lift actuator 136. The lift actuator 136 includes an upper screw section 138 is rotatably powered by an electric motor 140 operably connected to the upper end of the screw section. The top of the screw section is rotatably engaged with a retaining socket assembly 142 which is pinned to a U-shaped bracket 144 secured to the forward face of post 22 near the juncture of the post lower section 52 and upper section 54. A cross pin 146 extends through aligned openings formed in the flanges of the bracket 144 and aligned diametrically opposed apertures formed in the socket 142. The socket 142 allows the screw 138 to rotate relative to the socket while remaining in vertical engagement with the collar.

The lower portion of the screw section 138 threadably engages within a lower tubular casing 147 having its bottom end portion fixedly attached to crossbar 120. It will be appreciated that motor 140 may be operable to rotate the screw section 138 in one direction to lower the carriage 122 or in the opposite direction to raise the carriage, as desired. As the carriage is lowered or raised, the angle of inclination of the guide 36 is changed which in turn changes the stepping motion experienced by the user of apparatus 18. The engagement of the screw section 138 into the casing 120, and thus the angle of inclination of the guide 36, is readily discernible by standard techniques, for instance by using a rotating potentiometer 147, FIG. 14.

The forward hood 39 substantially encases the lift mechanism 38. The hood 39 extends forwardly from the side walls of the post lower and upper sections 52 and 54 to enclose the carriage 122, guide bar 126, lift actuator 136 and other components of the lift mechanism. Only the free ends of the cross bar 120 and associated roller tube sections 124 protrude outwardly from vertical slots 148 formed in the side walls of the hood 39. A plurality of fasteners 149 are provided to detachably attach the hood 39 to the side walls of the post 22.

The present invention includes a system for selectively applying the braking or retarding force on the rotation of the flywheels through a eddy current brake system 40. The brake system 40 includes a larger drive sheave 90, noted above, that drives a smaller driven sheave 150 through a V-belt 152. The driven sheave 150 is mounted on the free end of a rotatable stub shaft 154 that extends outwardly from a pivot arm 156 pivotally mounted to the rear side of rear post 86 by a U-shaped bracket 158 and a pivot pin 160 extending through aligned openings formed in the bracket as well as aligned openings formed in the side walls of the pivot arm 156. An extension spring 161 extends between the bottom of arm 156 at the free end thereof and the top of frame member 42 to maintain sufficient tension on belt 152 to avoid slippage between the belt and the sheaves 90 and 150. The relative sizes of sheaves 90 and 150 are such as to achieve a step of speed at about six to ten times and ideally about eight times. In other words, the driven shaft 154 rotates about six to ten times faster than the drive shaft 84.

A solid metallic disk 162 is mounted on stub shaft 154 inboard of driven sheave 150 to also rotate with the driven sheave. Ideally, an annular face plate 164 of highly electrically conductive material, e.g., copper, is mounted on the face of the solid disk 162 adjacent the driven pulley 150. A pair of magnet assemblies 168 are mounted closely adjacent the face of the solid disk 162 opposite the annular plate 164. The assemblies 168 each include a central core in the form of a bar magnet 170 surrounded by a coil assembly 172. The assemblies 168 are mounted on a keeper bar 174 by fasteners 176 extending through aligned holes formed in the keeper bar and the magnet cores. As illustrated in FIGS. 11 and 12, the magnet assemblies 168 are positioned along the outer perimeter portion of the disk 162 in alignment with the annular plate 164. The location of the magnet assemblies may be adjusted relative to the adjacent face of the disk 162 so as to be positioned as closely as possible to the disk without actually touching or interfering with the rotation of the disk. This positioning of the magnet assemblies 168 is accomplished by adjusting the position of the keeper bar 174 relative to a support plate 178 mounted on the rearward, free end of pivot arm 156. A pair of horizontal slots, not shown, are formed in the support plate 178 through which extend threaded fasteners 179 that then engage within tapped holes formed in the forward edge of the keeper bar 174.

As noted above, the significant difference in size between the diameters of drive sheave 90 and driven sheave 150 results in a substantial step up in rotational speed of the disk 62 relative to the rotational speed of the flywheels 24*a* and 24*b*. The rotational speed of the disk 62 is thereby sufficient to produce relatively high levels of braking torque through the eddy current brake assembly 40.

As discussed more fully below, it is desirable to monitor the speed of the flywheels 24*a* and 24*b* so as to measure the distance traveled by the user of the present apparatus and also to control the level of workout experienced by the user. Any standard method of measuring the speed of the flywheels may be utilized. For instance, an optical or magnetic strobe wheel may be mounted on disk 162, drive sheave 90 or other rotating member of the present apparatus. The rotational speed of the strobe wheel may be monitored by an optical or magnetic sensor 180 (FIG. 14) to generate an electrical signal related to such rotational speed.

Figure 13:
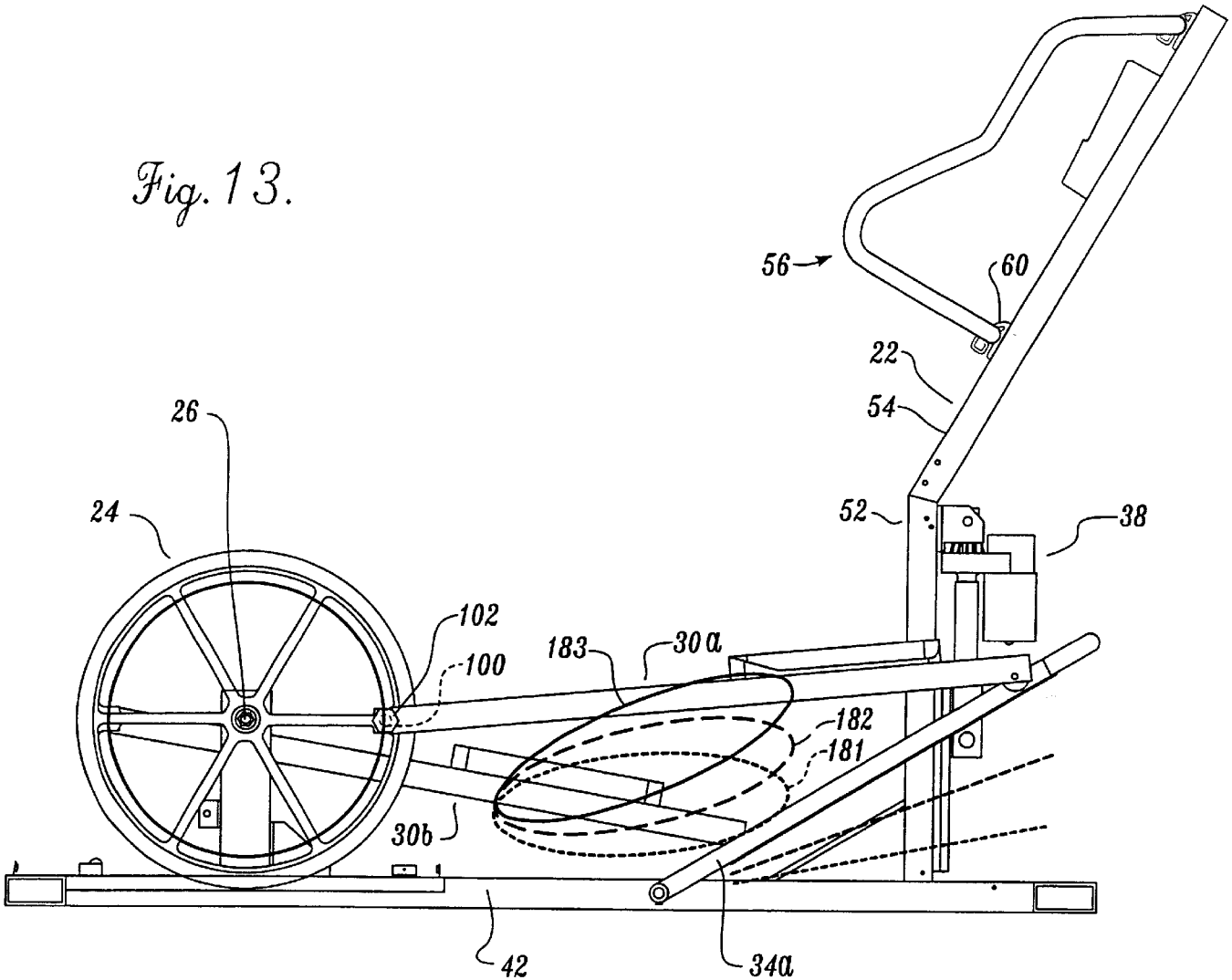
FIG. 13 is a side elevational view of the apparatus of the present invention shown in schematic illustrating the paths of the user's foot at different angles of inclination of the guide for the foot links.

To use the present invention, the user stands on the foot pads 27 while gripping the handle bar 56 for stability. The user imparts a downward stepping action on one foot pads thereby causing the flywheels 24*a* and 24*b* to rotate about axis 26. As a result, the rear ends of the foot links rotate about the axis 26 and simultaneously the forward ends of the foot links ride up and down the tracks 34*a* and 34*b*. The forward end of the foot link moves downwardly along its track as the point of attachment of the foot link to the flywheel moves from a location substantially closest to the post 22 (maximum extended position of the foot link) to a location substantially furthest from the post, i.e., the maximum retracted position of the foot link. From this point of the maximum retracted position of the foot link, further rotation of the flywheel causes the foot link to travel back upwardly and forwardly along the track 34*a* back to the maximum extended position of the foot link. These two positions are shown in FIG. 13. FIG. 13 also illustrates the corresponding path of travel of the center of the foot pads 27, and thus, the path of travel of the user's feet. As shown in FIG. 13, this path of travel is basically in the shape of a forwardly and upwardly tilted ellipse.

FIG. 13 shows the path of travel of the foot pad 27 at three different angular orientations of guide 36 corresponding to different elevations of the lift mechanism 38. In the smallest angular orientation shown in FIG. 13 (approximately 10° above the horizontal), the corresponding foot pad travel path 181 is illustrated. This generally corresponds to a gliding or cross-country skiing motion.

The guide 36 is shown at a second orientation at a steeper angle (approximately 20°) from the horizontal, with the corresponding path of travel, of the foot pedal 116 depicted by elliptical path 182. This path of travel generally corresponds to a walking motion. FIG. 13 also illustrates a third even steeper angular orientation of the guide 36, approximately 30° from the horizontal. The corresponding elliptical path of travel of the foot pad 27 is illustrated by 183 in FIG. 13. This path of travel corresponds to a climbing motion. It will be appreciated that by adjusting the angle of the guide 36, different types of motion are attainable through the present invention. Thus, the present invention may be utilized to emulate different types of physical activity, from skiing to walking to running to climbing. Heretofore to achieve these different motions, different exercise equipment would have been needed.

Applicants note that in each of the foregoing different paths of travel of the foot pad, and thus also the user's feet, a common relationship occurs. When the rear end of a foot link travels forwardly from a rearmost position, for instance, as shown in FIG. 13, the heel portion of the user's foot initially rises at a faster rate than the toe portion of the user's foot. Correspondingly, when the rearward end of the foot link travels rearwardly from a foremost position, the heel portion of the user's foot initially lowers at a faster rate than the toe portion. This same relationship is true when the forward ends of the foot links travel from a position at the lower end of the guide 36 to a position at the upper end of the guide 36. In other words, when the forward end of a foot link travels from a lower, rearmost point along guide 36 forwardly and upwardly along the guide, the heel portion of the user's foot initially rises at a faster rate than the toe portion. Correspondingly, when the forward end of the foot link travels downwardly and rearwardly from an upper, forwardmost location along the guide 36, the heel portion of the user's foot initially lowers at a faster rate than the toe portion. This generally corresponds with the relative motion of the user's heel and toe during cross country skiing, walking, running and climbing or other stepping motions.

Figure 14:
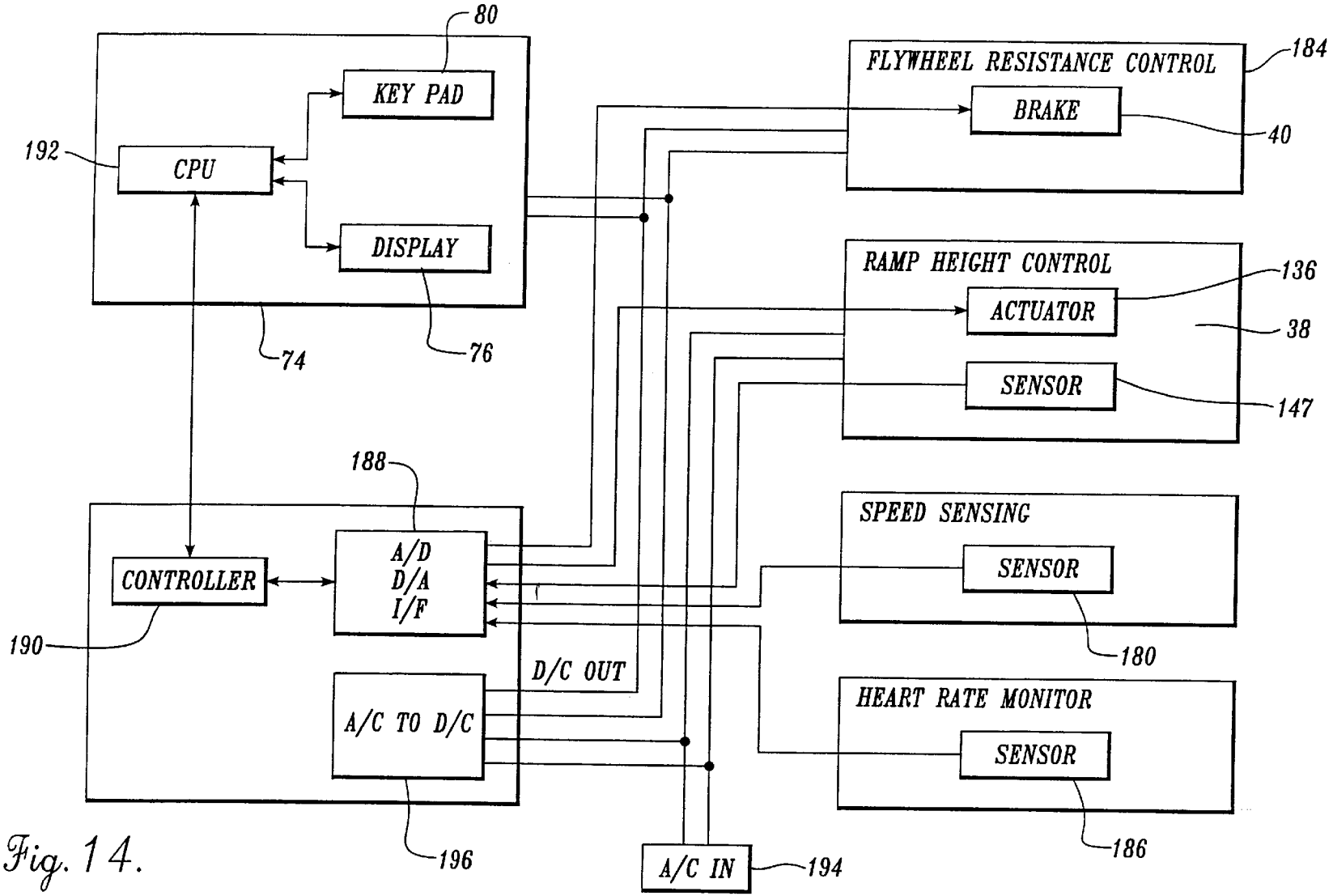
FIG. 14 is a schematic drawing of the system utilized in the present invention for altering the workout level while utilizing the present apparatus; and, FIG. 15 is a side elevational view of a further preferred embodiment of the present invention.

Applicants' system 184 for controlling and coordinating the angle of inclination of the guide 36 and the resistance applied to the rotation of the flywheels 24*a* and 24*b* to achieve a desired workout level is illustrated schematically in FIG. 14. As shown in FIG. 14, a physical workout parameter, e.g., user's heart rate, is monitored by a sensor 186. An electrical signal, typically analog in nature, related to the user's heart rate is generated. Various types of heart rate monitors are available, including chest worn monitors, ear lobe monitors and finger monitors. The output from the monitor 186 is routed through an analog to digital interface 188, through controller 190 and to a central processing unit (CPU) 192, ideally located within display panel 74. In addition to, or in lieu of, the user's heart rate, other physical parameters of the exerciser may be utilized, including respiratory rate, age, weight, sex, etc.

Continuing to refer to FIG. 14, the exercise control system 184 of the present invention includes an alternating current power inlet 194 connectable to a standard amperage AC 110 volt power supply. The power inlet 194 is routed to a transformer 196 and then on to the brake system 40 and the display panel 74. The lift mechanism 38 utilizes AC power, and thus, is not connected to the transformer 196.

As previously discussed, the lift mechanism 38 incorporates a sensing system 147 to sense the extension and retraction of the lift mechanism, and thus, the angle of inclination of the guide 36. This information is routed through the analog to digital interface 188, through controller 190 and to the CPU 192. The rotational speed of the flywheels 24*a* and 24*b* is also monitored by a sensor 180, as discussed above, with this information is transmitted to the CPU through the analog to digital interface 188 and controller 190. Thus, during use of the apparatus 18 of the present invention, the CPU is apprised of the heart rate or other physical parameter of the exerciser being sensed by sensor 186, the angle of inclination of the guide 36 and the speed of the flywheels 24*a* and 24*b*. This information, or related information, may be displayed to the exerciser through display 76.

Further, through the present invention, a desired workout level may be maintained through the control system 184. For instance, certain parameters may be inputted through the keypad 80 by the exerciser, such as age, height, sex, to achieve a desired heart rate range during exercise. Alternatively, the desired heart rate range may be directly entered by the exerciser. Other parameters may or may not be inputted by the exerciser, such as the desired speed of the flywheels corresponding to cycles per minute of the foot links and/or inclination of the guide 36. With this information, the control system of the present invention will adjust the braking system 40 and/or lift mechanism 38 to achieve the desired workout level.

It is to be understood that various courses or workout regimes may be preprogrammed into the CPU 192 or designed by the user to reflect various parameters, including a desired cardiovascular range, type of stepping action, etc. The control system 184 thereupon will control the brake system 40 as well as the lift mechanism 38 to correspond to the desired workout regime.

Figure 15:
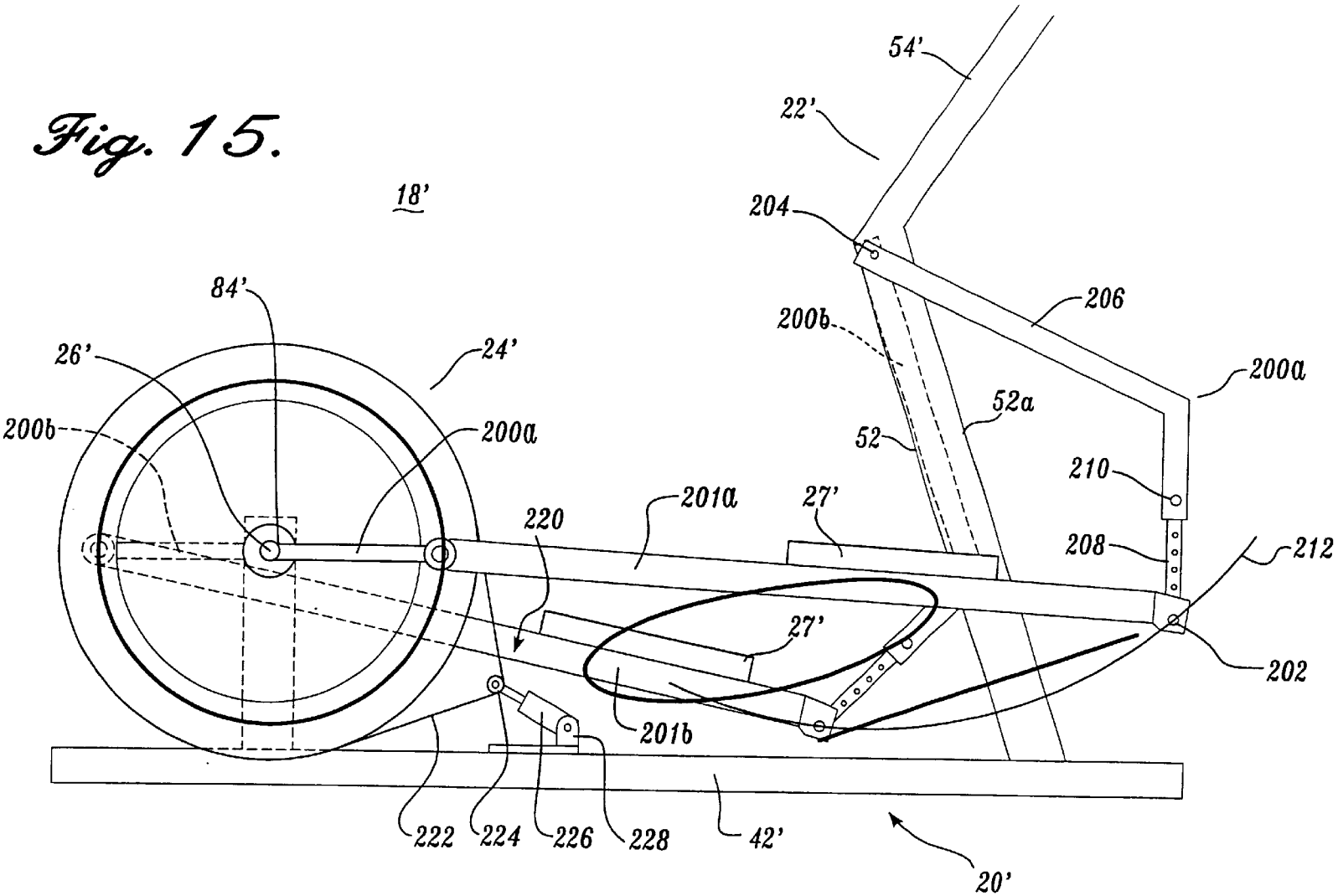

A further preferred embodiment of the present invention is illustrated in FIG. 15. The apparatus 18' shown in FIG. 15 is constructed similarly to apparatus 18 shown in the prior figures. Accordingly, those components of apparatus 18' that are the same as, or similar to, those components of apparatus 18 bear the same part number, but with the addition of the prime ("") designation.

Apparatus 18' includes a single flywheel 24' rotatably mounted at the rear of frame 20'. A pair of crank arms 200*a* and 200*b* extend transversely in diametrically opposite directions from the ends of a drive shaft 84' to pivotally connect to the rear ends of foot links 201*a* and 201*b*. The crank arms 200*a* and 200*b* are fixedly attached to the drive shaft 84'. It will be appreciated that the crank arms 200*a* and 200*b* support the rear ends of the foot links 201 a and 201*b* during fore and aft motion thereof. In this regard, the lengths of the crank arms can be altered to change the "stroke" of the foot links to accommodate uses of different leg/inseam lengths.

The forward ends of the foot links 201*a* and 201*b* are pivotally pinned to the lower ends of rocker or swing arms 200*a* and 200*b* at pivot joints 202. The swing arms are preferably tubular in construction and dog-leg in shape, having their upper ends pinned to post 22' at axis 204 near the intersection of lower section 52' and upper section 54' of the post. Each of the swing arms includes a tubular upper section 206 and a tubular lower section 208. The upper end portion of the lower section 208 slidably engages within the lower end portion of a corresponding upper section 206, thereby to selectively alter the length of the swing arms. The swing arm upper and lower sections may be maintained in engagement with each other by any convenient means, such as by a cross pin 210 extending through diametrically aligned openings formed in the swing arm upper section and one of the sets of diametrically aligned openings formed in the lower sections.

Although not illustrated, an extension spring or other device may be located with the interior of the swing arm upper and lower sections to bias the upper and lower sections into engagement with each other. Alternatively, the engagement of the swing arm upper and lower sections may be "automatically" controlled by incorporating a linear actuator or other powered device into the construction of the swing arms.

The swing arms 200*a* and 200*b* support the forward ends of the foot links 201*a* and 201*b* to travel along an arcuate path 212 defined by the pivot axis 204 of the upper ends of the swing arms about post 22' and the radial length between such axis 204 and the pivot point 202 defining the connection point of the forward end of the foot link and the lower end of its corresponding swing arm. It will be appreciated that the path 212 may be altered as the relative engagement between the swing arm upper section 206 and lower section 208 is changed. This results in a change in the stepping motion experienced by the user, which stepping motion may be altered in a manner similar to that achieved by varying the angle of inclination of guide 36, discussed above. As such, the apparatus 18' is capable or providing the same advantages as provided by the apparatus 18, noted above.

A band brake system 220 is provided to selectively impart rotational resistance on the flywheel 24'. The band brake system includes a brake band 222 that extends around the outer rim of the flywheel 24' and also about a small diameter takeup roller 224 that is rotatably attached to the outer/free end of a linear actuator 226. The opposite end of the linear actuator is pivotally pinned to a mounting bracket 226 attached to frame 42'. It will be appreciated that the linear actuator may be mechanically, electrically or otherwise selectively controlled by the user to impart a desired frictional load on the flywheel 24'. Also, other known methods may be used to impart a desired level of rotational resistance on the flywheel 24'. For instance, a caliper brake (not shown) can be employed to engage against the outer rim portion of the flywheel itself or on a disk (not shown) that rotates with the flywheel.

Figure 16:
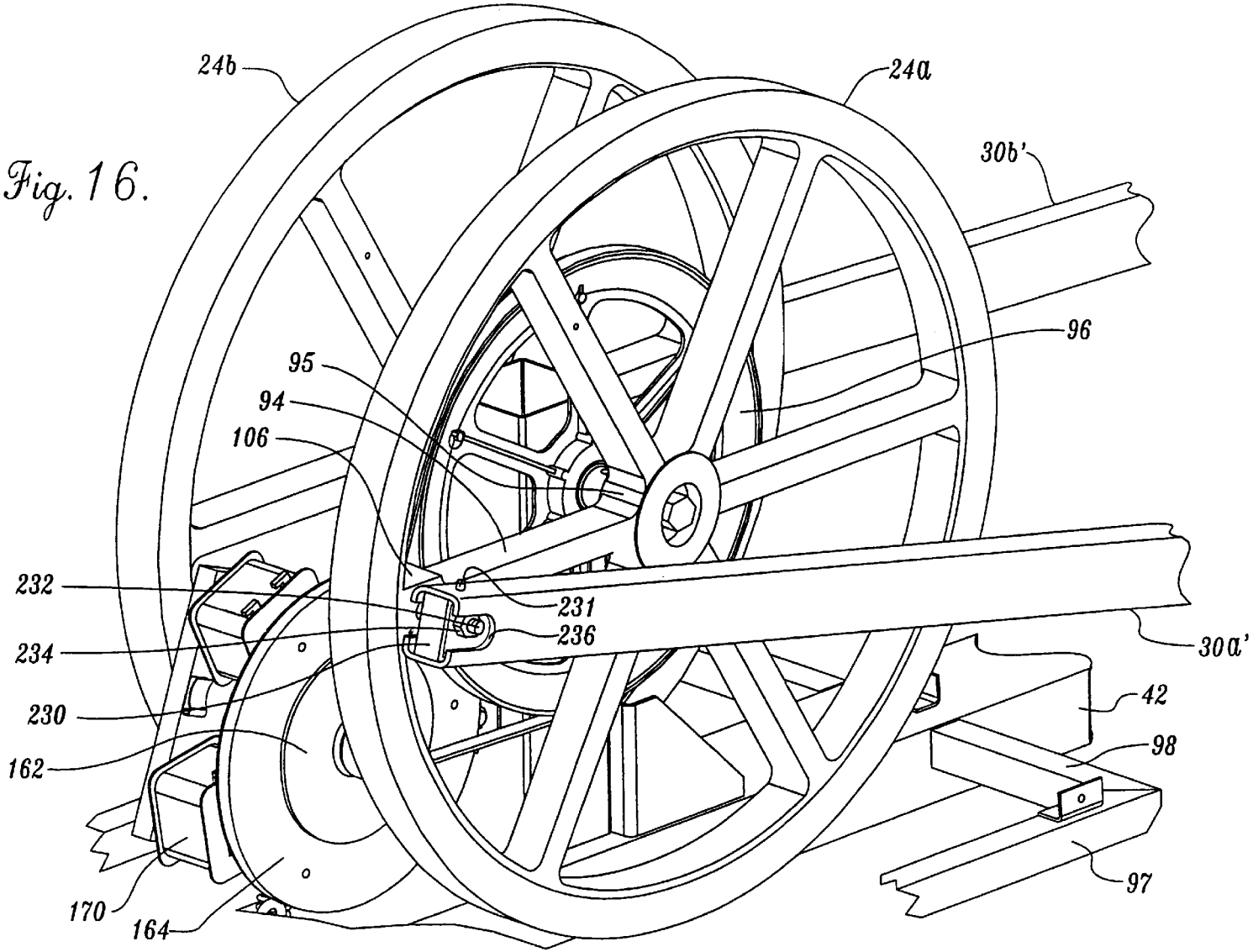
FIG. 16 is an enlarged, partial perspective view of a further preferred embodiment of the present invention.

A still further preferred embodiment of the present invention is illustrated in FIG. 16. Multi-pivoting connections between the foot links 30*a*' and 30*b*' to flywheels 24*a* and 24*b* are provided. A rail pivot block 230 is pivotally pinned to each flywheel 24*a* and 24*b* at apertures 104 by a threaded fastener 232 and mating nut 234. The rail pivot blocks 230 move in a plane approximately parallel to the plane of the corresponding flywheel. Foot links 30*a*' and 30*b*' are hollow at the rear ends for receiving the rail pivot blocks 230. A block mounting pin 231 extends through opposing holes on the top and bottom of the rear end of foot links 30*a*' and 30*b*' and snugly through a hole in the pivot block for attaching the pivot block 230 to the rear end of the foot links. Slots 236 extend longitudinally from the rear ends of foot links 30*a* and 30*b* allow access to the fasteners 232 and 234.

Ideally, the rail pivot blocks 230 are generally rectangular in shape and sized to fit between the upper and lower flange walls of the hollow foot links. However, the internal width of the flange portions of the foot links is wider than the thickness of the rail pivot blocks 230 to allow angular displacement of the foot links relative to pivot block about mounting pin 231, which acts as the pivot point. This construction provides a foot link connection between the flywheels 24*a* and 24*b* and guides 36 that compensate for possible inconsistencies in the alignment of the flywheels 24*a* and 24*b* as well as the guide 36, especially in the direction transverse to the length of the foot links 30*a* and 30*b*. It can be appreciated to one of ordinary skill that varying the thickness of rail pivot blocks 230 and the position of the block mounting pins 231 allow a designer to fine tune the construction depending on expected tolerances that may occur in the alignment of the other components of the present invention.

Figure 17:
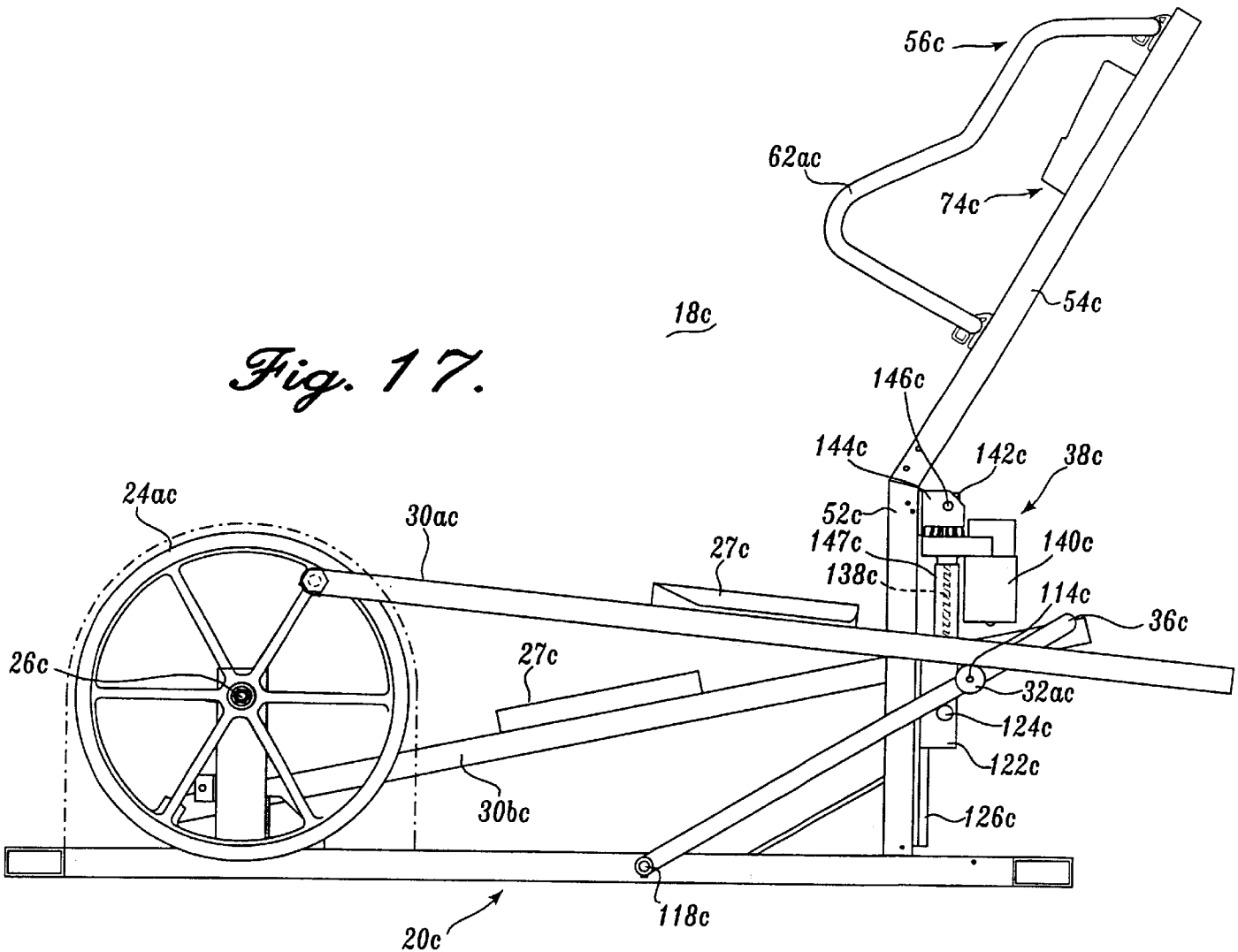
FIGS. 17–24 are side elevational views of further preferred embodiments of the present invention.

A further preferred embodiment of the present invention is illustrated in FIG. 17. The apparatus 18*c* shown in FIG. 17 is constructed similarly to the apparatus 18 and 18' shown in the prior figures. Accordingly, those components of apparatus 18*c* that are the same as, or similar to, those components of apparatus 18 and 18' bear the same number, but with the addition of the "c" suffix designation.

Apparatus 18*c* includes a pair of foot links 30*ac* and 30*bc* supported at their forward and rear ends to provide elliptical foot motions similar to that achieved by apparatus 18 and 18', for instance, as shown in FIG. 13. In this regard, the rear ends of the foot links 30*ac* and 30*bc* are pinned to flywheels 24*ac* and 24*bc* in the manner described above and shown in FIG. 16. The forward ends of the foot links 30*ac* and 30*bc* are supported by rollers 32*ac* and 32*bc* (not shown) which are axled to the sides of guide 36*c*. The guide 36*c* is in turn supported by a powered lift mechanism 38*c* which is similar in construction and operation to the lift mechanism 38 described above. As in lift mechanism 38, the lift mechanism 38*c* includes a crossbar supported by and vertically carried by a carriage 122*c* which is restrained to travel vertically along the height of a central guide bar 126*c* which in turn is securely fastened to the forward face of the post lower section 52*c*.

In a manner similar to that described above and illustrated in FIGS. 9 and 10, the carriage 122*c* is raised and lowered by an electrically powered actuator 136*c*, which includes an upper screw section 138*c* rotatably powered by an electric motor 140*c*. The upper end of the screw section is rotatably engaged within a retaining socket assembly 142*c* which is pinned to a U-shaped bracket 144*c* secured to the forward face of post lower section 52*c*. A cross-pin 146*c* extends through aligned openings formed in the side flanges of the bracket 144*c* and aligned diametrically opposed apertures formed in the socket 142*c*. The socket allows the screw of the lift actuator to rotate relative to the socket while remaining in vertical engagement with the collar. As in lift mechanism 38, in lift mechanism 38*c* shown in FIG. 17, roller tube sections 124*c* are mounted on the outer end of the crossbar carried by the carriage to directly underlie and bear against the bottoms of the sides of guide 36*c*. By this construction guide 36*c* is raised and lowered about cross tube 118*c* by operation of the motor 140*c*.

Apparatus 18*c* operates in a manner very similar to apparatus 18, discussed above, wherein the user stands on foot pads 27*c* while gripping handlebar 56*c* for stability. The user imparts a downward stepping action on one of the foot pads, thereby causing the flywheels 24*ac* and 24*bc* to rotate about axis 26*c*. As a result, the rear ends of the foot links travel about the axis 26*c* and simultaneously the forward ends of the foot links ride fore and aft on rollers 32*ac* and 32*bc*. As in apparatus 18, in apparatus 18*c* the path of travel of the center of the foot pads 27*c* generally define an ellipse. The angular orientation of this elliptical path may be tilted upwardly and downwardly by operation of the lift mechanism 38*c*. As a result, the user can adjust apparatus 18*c* to approximate gliding or cross country skiing, jogging, running and climbing, all by raising and lowering the elevations of support rollers 32*ac* and 32*bc*.

Figure 18:
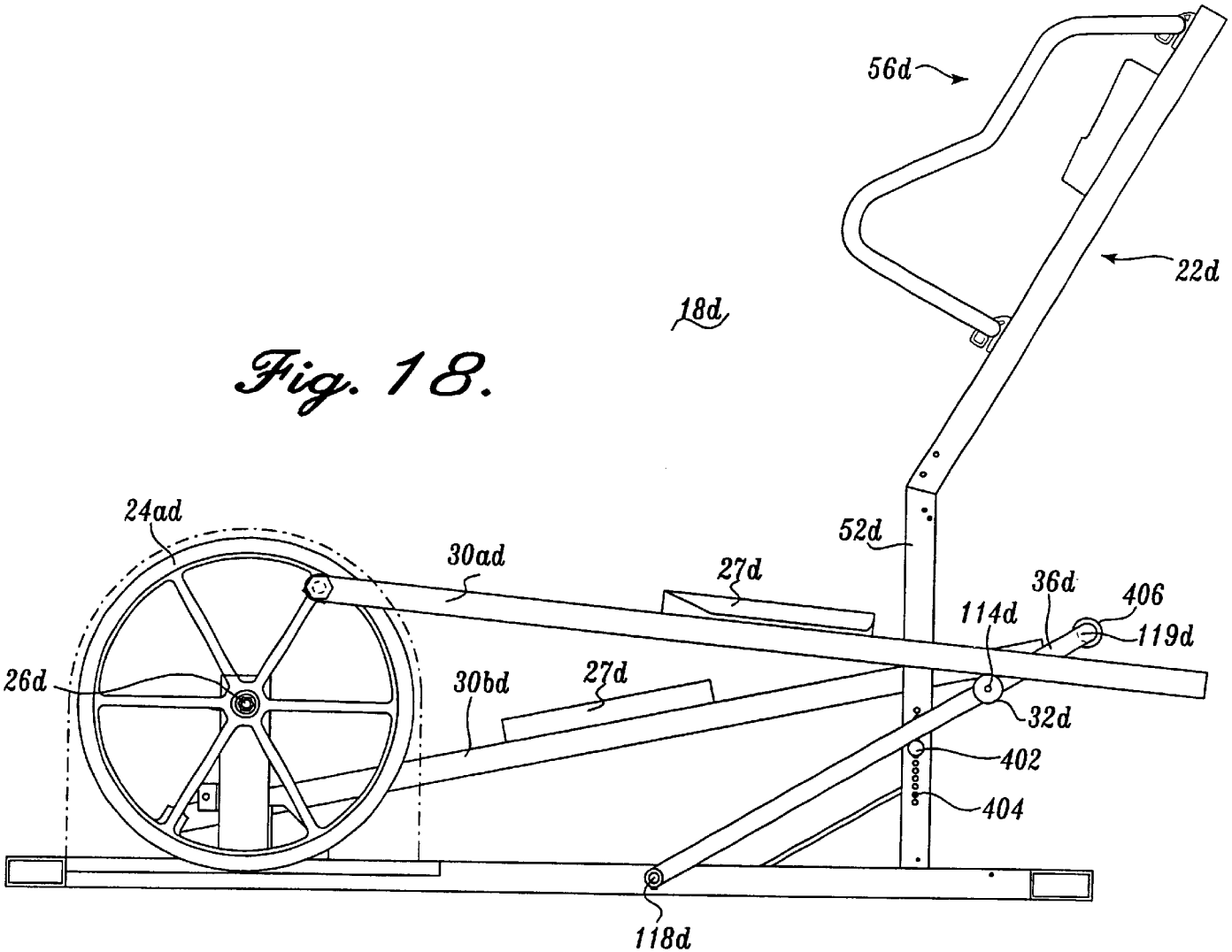

Next, referring to FIG. 18, an apparatus 18*d* is depicted which is constructed quite similarly to apparatus 18*c* in FIG. 17, but with a manual lift mechanism 38*d* rather than a powered lift mechanism 38*c*. Those components of FIG. 18 that are similar to those illustrated in FIG. 17 or those in other prior figures are given the same part number, but with a "d" suffix designation rather than a "c" suffix designation.

In apparatus 18*d*, the guide 36*d* is supported relative to post 22*d* by a cross-pin 402 which extends through cross-holes 404 formed in lower section 52*d* of the post 22*d*. The cross-pin 402 may be conveniently disengaged from and engaged into the cross-holes 404 with one hand, while manually supporting the transverse, forward end of guide 36*d* with the other hand. To this end, a tubular-shaped hand pad 406 may be engaged over the guide end 119*d* for enhanced grip and comfort.

The levels and types of exercise provided by apparatus 18*d* is essentially the same as the prior described embodiments of the present invention, including that shown in FIG. 17. In this regard, the guide 36*d* may be raised and lowered so as to enable the user to achieve different types of exercise from a gliding or cross-country skiing motion to a walking motion to a jogging or running motion to a climbing motion. Thus, the advantages provided by the embodiments of the present invention described above are also achieved by apparatus 18*d*.

Rather than utilizing the cross pin 402 to support guide 36*d*, a carriage similar to carriage 122*c* of FIG. 17 might be employed together with a guide bar similar to guide bar 126*c* for guiding the carriage for vertical movement. However, rather than employing a powered actuator 136*c*, a spring loaded plunger pin, not shown, could be mounted on the carriage to engage within receiving holes formed in the guide bar or the lower section of the post. Such plunger pins are articles of commerce, see for instance, U.S. Pat. No. 4,770,411. In this manner, the guide 36*d* may be manually raised or lowered by grasping handle 406 and the plunger pin inserted into a new location, thereby to raise or lower the guide as desired.

Figure 19:
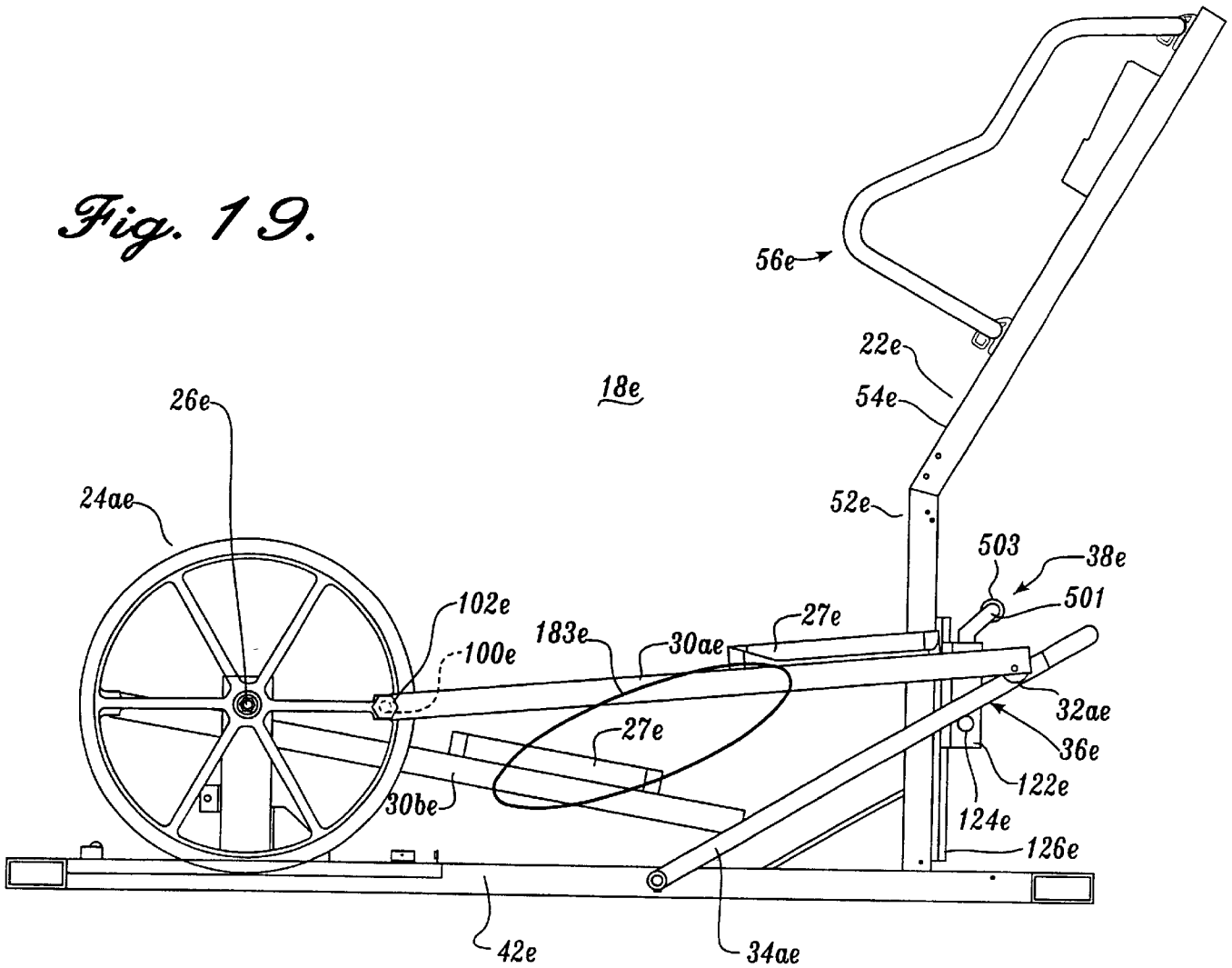

FIG. 19 illustrates another preferred embodiment of the present invention constructed similarly to the apparatus 18 shown in the prior figures, but with a manually operated lift mechanism 38*e*. Accordingly, those components of apparatus 18*d* shown in FIG. 19 that are the same as, or similar to, those components of apparatus 18 bear the same part number, but with the addition of a "e" suffix designation.

As shown in FIG. 19, the foot links 30*ad* and 30*bd* are constructed essentially the same as foot links 30*a* and 30*b*, including with rollers 32*ae* and 32*be* pinned to the forward ends of the foot links. The rollers 32*ae* and 32*be* ride on the tubular side tracks 34*ae* and 34*be* of guide 36*e*. The guide 36*e* is raised and lowered by a manual lift mechanism 38*e* composed of a carriage 122*e* that is slidably engaged with a vertical guide bar 126*e* mounted on the forward face of post lower section 52*e*. A handle 501 extends forwardly and diagonally upwardly from the upper end portion of the carriage 122*e* for manual grasping by the user. Ideally the handle is U-shaped having side arms extending diagonally upwardly and forwardly from the carriage to intersect with a transverse cross member spanning across the front of carriage 22*e*. A tubular shaped handle pad 503 may encase the transverse end portion of handle 501 to aid in gripping the handle when lowering or raising the carriage 122*e*.

As in carriage 122, roller tube sections 124*e* are mounted on the other ends of a cross bar carried by the carriage to directly underlie and bear against the bottoms of the sides of guide 36*e*. Also, a spring loaded plunger pin, not shown, is mounted on the carriage 122*e* to engage within a series of holes spaced along the height of guide bar 126*e*. Such plunger pins are standard articles of commerce. For instance, they are commonly used to support the seat of exercise cycles in desired positions. See U.S. Pat. No. 4,770,411 noted above.

By the foregoing construction, the guide 36*d* may be raised and lowered so as to enable the user to achieve the same types of exercise as provided by apparatuses 18, 18', 18*c* and 18*d* discussed above.

Figure 20:
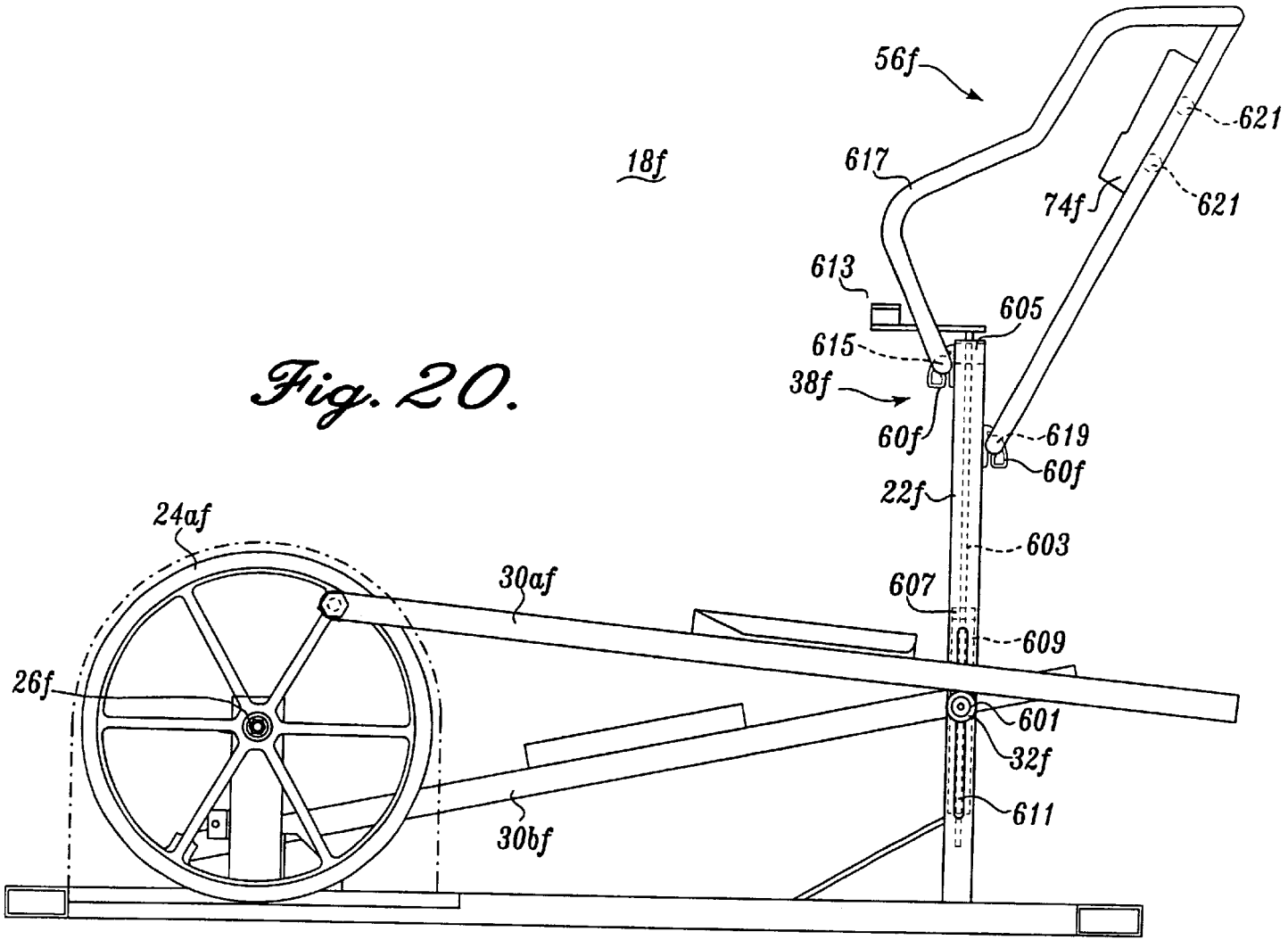

Next referring to FIG. 20, an apparatus 18f consisting of a further preferred embodiment of the present invention is illustrated. Those components of apparatus "18*f*" that are the same as, or similar to, those components illustrated in the prior figures, are given the same part number, but with a "f" suffix designation.

As in the prior embodiments of the present invention discussed above, apparatus 18*f* also utilizes a pair of foot links 30*af* and 30*bf* supported at their forward and rear ends to provide elliptical foot motion similar to that achieved by the apparatuses described above, for instance, as shown in FIG. 13. In this regard, the rear ends of the foot links are pinned to flywheels 24*af* and 24*bf*, in the manner described and shown with respect to FIG. 16. The forward ends of the foot links 30*af* and 30*bf* are supported by rollers 32*af* and 32*bf* (not shown) which are mounted on a cross shaft 601 extending transversely outwardly from post 22*f* to support the undersides of the forward ends of the foot links 30*af* and 30*bf*. As in the prior embodiments of the present invention, foot pads 27*f* are mounted on the top sides of the foot links 30*af* and 30*bf* to support the feet of the user.

A manually operated lift mechanism 38*f* is employed to raise and lower the support rollers 32*f*. The lift mechanism is in the form of a lead screw mechanism somewhat similar to that disclosed in U.S. Pat. No. 5,007,630 for raising and lowering the forward end of an exercise treadmill. The lift mechanism 38*f* employs a lead screw 603 which is vertically supported within post 22*f* by a bushing assembly 605 mounted at the top of the post 22*f*. The lead screw 603 is threadably engaged with a cap 607 affixed to the upper end of a slide tube 609 sized to closely and slidably engage within the post 22*f*. A cross shaft 601 extends transversely outwardly from each side of the slide tube and through slots 611 formed in the sidewalls of post 22*f*. The rollers 32*af* and 32*bf*, as noted above, are supported by the outward ends of the cross shaft 601. A hand crank 613 is mounted on the upper end of the lead screw 603 extending above the post 22*f*. By rotating the hand crank 613, the support rollers 32*af* and 32*bf* may be raised and lowered thereby to achieve the same range of exercise motions achieved by the previously described embodiments of the present invention.

Still referring to FIG. 20, a continuous, closed form handle bar 56*f* is mounted on the upper portion of post 22*f* for grasping by an individual utilizing the present apparatus 18*f*. The handle bar 56*f* includes an upper transverse section 615 which is clamped to the upper rear side of post 22*f* by a clamp 60*f*. The handle bar 56*f* includes side sections 617 that extend upwardly and forwardly from the transverse ends of section 615, then extend generally horizontally forwardly and then extend downwardly and rearwardly to intersect with the outer ends of transverse lower section 619. The transverse lower section 619 is clamped to the front side of post 22*f* with a second clamp 60*f* at an elevation below the elevation of upper transverse section 615. By this construction of the handle bar 56*f*, the area around hand crank 613 is substantially open so as to not hinder the manual operation of the hand crank. The handle bar 56*f* also includes a pair of transverse members 621 that span across the side sections 617 to support the display 74*f*.

Figure 21:
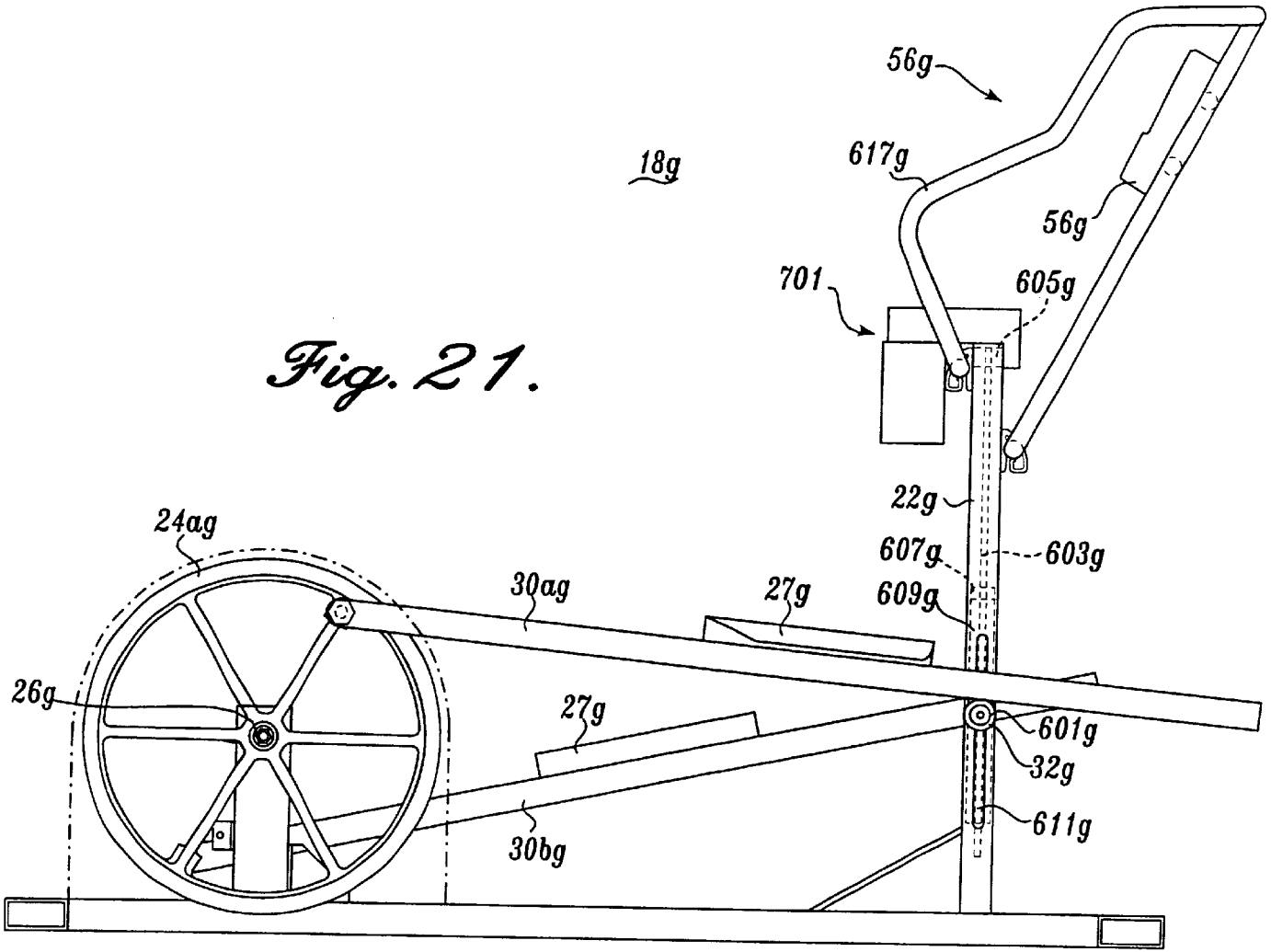

FIG. 21 illustrates a further embodiment of the present invention wherein apparatus 18*g* is constructed very similarly to apparatus 18*f*, but with an electrically powered lift mechanism 38*f*. The components of apparatus 18*g* that are similar to the components of the prior embodiments of the present invention are given the same part number, but with an "g" suffix designation.

As illustrated in FIG. 21, the apparatus 18*g* is constructed almost identically to that shown in FIG. 20, but with an electric motor assembly 701 mounted on the upper end of post 22*g* for operating the lead screw 603*g* rather than having to manually rotate the lead screw in the manner of the apparatus 18*f* shown in FIG. 20. In a manner known in the art, the motor assembly 701 may be controlled by push buttons or other interface devices mounted on display panel 74*g*.

Figure 22:
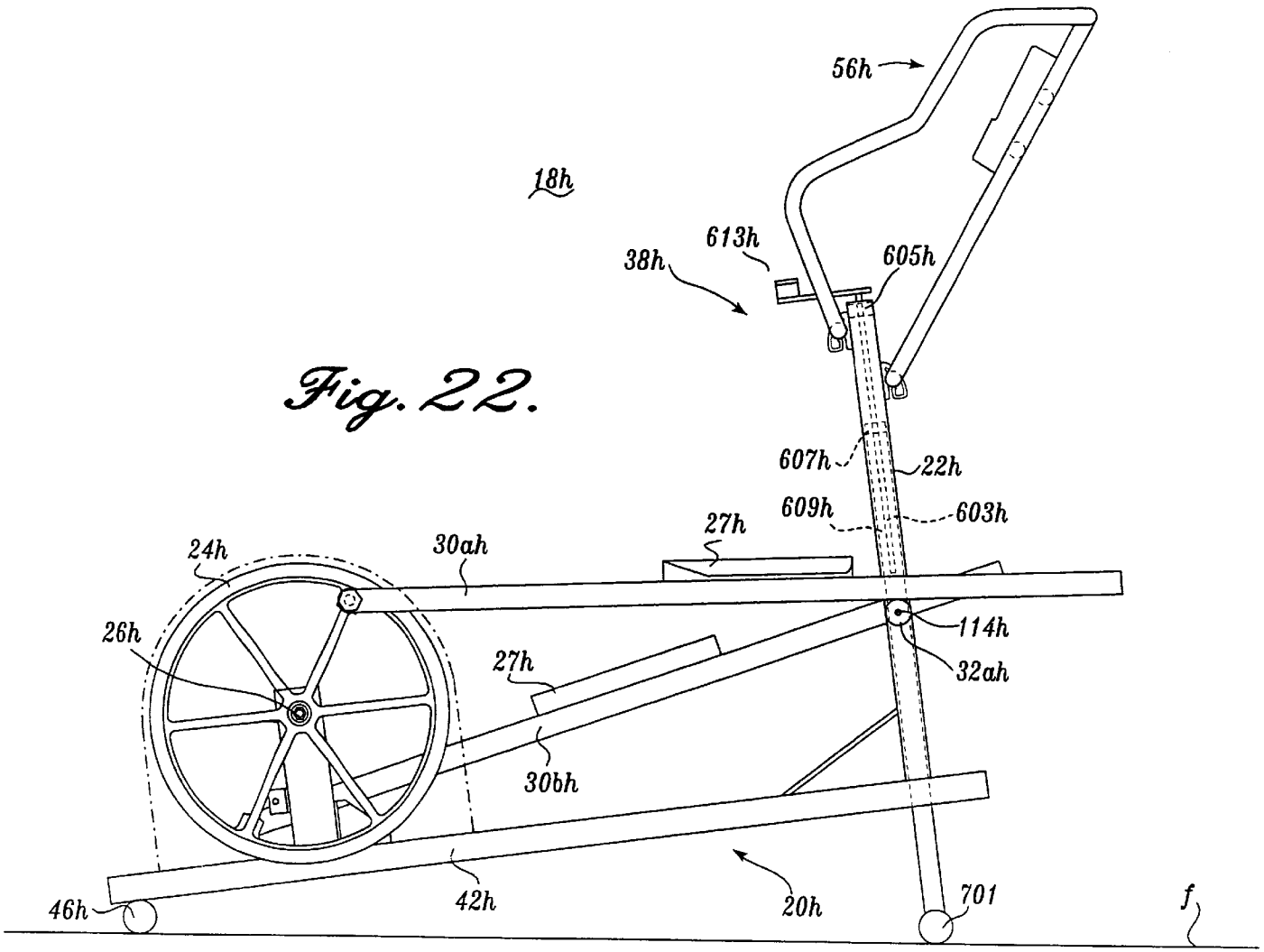

A further preferred embodiment of the present invention is illustrated in FIG. 22. The apparatus 18*h* shown in FIG. 22 is constructed somewhat similarly to the apparatuses of the prior figures. Accordingly, those components of apparatus 18*h* that are the same as, or similar to, those components of the prior embodiments of the present invention are given the same part number, but with the addition of the "h" suffix designation.

The apparatus 18*h* includes a frame 20*h* similar to the frames of the prior embodiments of the present invention, but with a rear cross member 46*h* extending transversely beneath the longitudinal central member 42*h* of the frame. Ideally, the rear cross member 46*h* is of circular exterior shape so as to enable the frame 20*h* to tilt about the rear cross member during operation of a manual lift system 38*h*.

A post 22*h* extends transversely upwardly from the forward end of the frame longitudinal central member 42*h*. As in the prior embodiments of the present invention, apparatus 18*h* includes a pair of foot links 30*ah* and 30*bh* supported at their rearward and forward ends to cause the foot receiving pedals carried thereby to travel about elliptical paths similar to the elliptical paths of the apparatuses described above. To this end, the rearward ends of the foot links are pinned to flywheels 24*ah* and 24*bh* in a manner described and illustrated previously. The forward ends of the foot links 30*ah* and 30*bh* are supported by rollers 32*ah* and 32*bh* (not shown) which are rotatably axeled on stub shafts 114*h* extending laterally outwardly from the sides of post 22*h* at an elevation intermediate the height of the post.

The lift mechanism 38*h* is incorporated into the construction of the post 22*h*. Such lift mechanism is similar to that illustrated in FIG. 20 in that the lift mechanism is of a manually operated lead screw type. In this regard, the lift mechanism includes a lead screw 603*h* extending downwardly into post 20*h* and supported therein by a bushing assembly 605*h* located at the top of the post. The lead screw 603*h* engages within a threaded cap 607*h* secured to the upper end of a slide tube 609*h* closely disposed within the interior of the post 22*h*. The slide tube extends outwardly through the bottom of the post and a through hole formed in frame longitudinal central member 42*h*. A transverse forward cross member 701 is secured to the bottom of slide tube 609*h* to bear against the floor f. It will be appreciated that by manual operation of the crank 613*h*, the apparatus 18*h* may be tilted upwardly and downwardly relative to the rear cross member 46*h*. As a result, the user of apparatus 18*h* may alter his/her exercise from a gliding or cross country skiing motion, to a walking motion, to a running or jogging motion to a climbing motion, in a manner similar to the previously described preferred embodiments of the present invention.

The apparatus 18*h* may utilize a handle bar 56*h* constructed similarly to handle bars 56*f* and 56*g* described and illustrated in FIGS. 20 and 21, above. As such, the construction of the handle bar 56*h* will not be repeated at this juncture.

Figure 23:
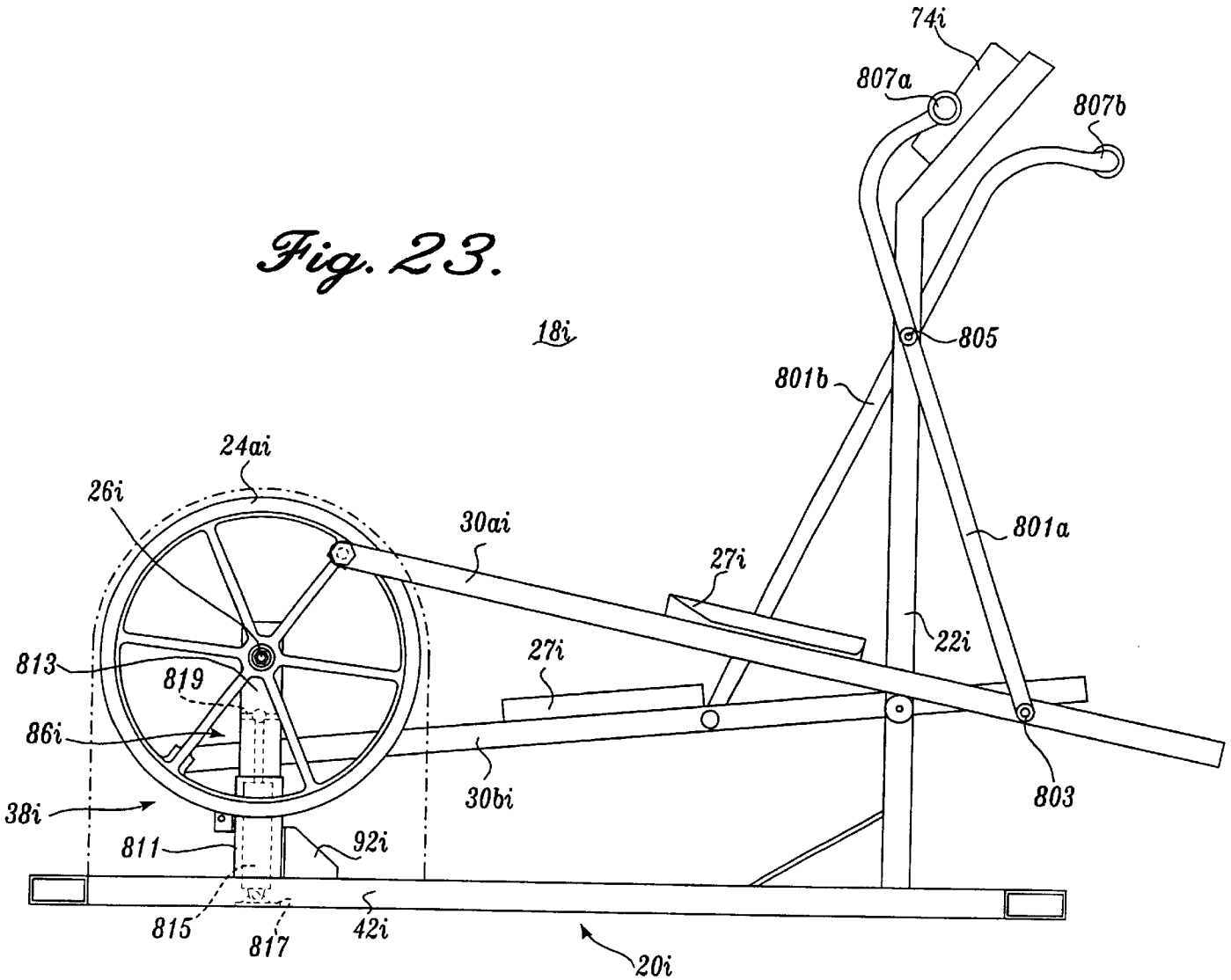

Another preferred embodiment of the present invention is illustrated in FIG. 23. The apparatus 18*i* shown in FIG. 23 is constructed similarly to the previously described apparatuses. As such, those components of apparatus 18*i* that are the same as, or similar to, the components of the previously described apparatuses bear the same part number, but with the addition of the "i" suffix designation.

As in FIG. 22, apparatus 18*i* shown in FIG. 23, includes a pair of foot links 30*ai* and 30*bi* carried at their reward and forward ends to cause foot receiving pedals 27*i* carried thereby to travel along elliptical paths similar to the elliptical paths of the apparatuses described above. To this end, the rear ends of the foot links are pinned to flywheels 24*ai* and 24*bi* in a manner described and shown with respect to FIG. 16. The forward ends of the foot links 30*ai* and 30*bi* are supported by the lower ends of rocker or swing arms 801*a* and 801*b* at lower pivot joints 803. The swing arms 801*a* and 801*b* are pivotally coupled to a cross arm 805. extending outwardly from each side of post 22*i*. The upper ends of the swing arms 801*a* and 801*b* are formed into manually graspable handles 807*a* and 807*b* that swing laterally outwardly from a display panel 74*i* mounted on the upper end of post 22*i*.

The swing arms 801*a* and 801*b* support the forward ends of the foot links 20*ai* and 20*bi* to travel along arcuate paths defined by the pivot axis corresponding to cross arm 805 and the radial length between such axes and the pivot joint 803 connecting the forward ends of the foot links and the lower ends of the swing arms. As a result, the foot pedals 27*i* define elliptical paths of travel as the rearward ends of the foot links travel about axis 26*i* and the forward ends of the foot links swing in arcuate paths defined by swing arms 801*a* and 801*b*.

The arcuate path of travel of the foot pedals 27*i* may be altered by operation of lift mechanism 38*i* incorporated into the rear post assembly 86*i* used to support the flywheels 24*ai* and 24*bi*. The rear post assembly 86*i* includes a lower member 811 which is fixedly attached to frame longitudinal member 42*i* by any expedient manner, such as by welding or bolting. In accordance with the preferred embodiment of the present invention, a corner brace 92*i* is employed at the juncture of the forward lower face of post lower section 811 with the upper surface of the longitudinal member 42*i* to provide reinforcement therebetween. Of course, other types of bracing are reinforcements may be utilized.

The rear post assembly 86*i* includes an upward telescoping section 813 that slidably engages within the post lower section 811. The relative engagement between the post upper and lower sections 813 and 811 is controlled by a linear actuator 815 having its lower end pinned to a removable plate 817 disposed flush with, or raised upwardly from, the bottom surface of frame longitudinal member 42*i*. The upper end of the linear actuator 815 is pinned to the post upper section 813 by any convenient means. For example, a plate 819 or other anchor structure may be provided within the interior of the post upper section 813 for coupling to the upper end of the linear actuator 815. The linear actuator 815 may be in the form of a pneumatic or hydraulic cylinder, an electrically powered lead screw or an electromagnetic coil or other type of actuator, all of which are articles of commerce.

Figure 24:
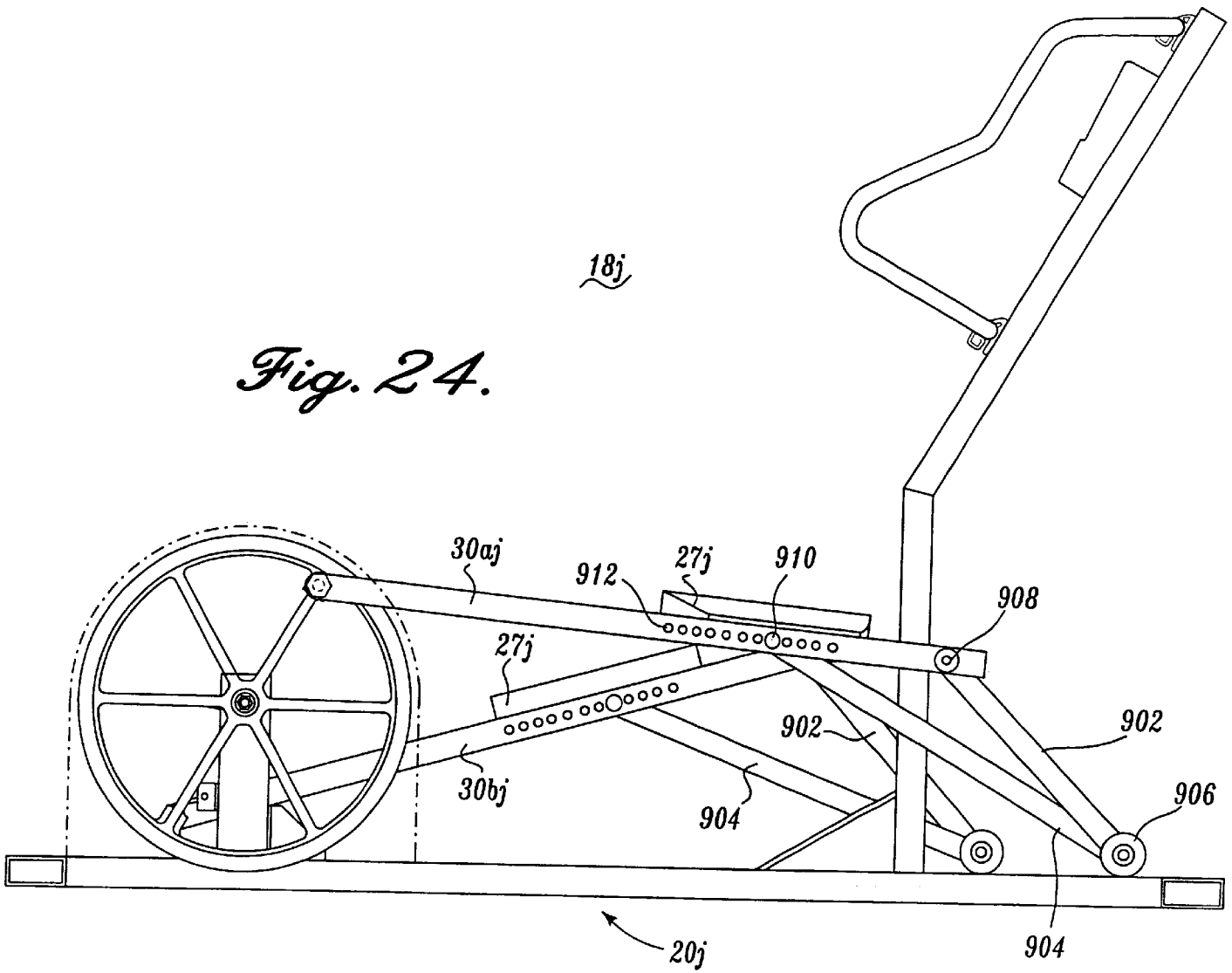

Next referring to FIG. 24, a further preferred embodiment of the present invention is illustrated. The apparatus 18*j* illustrated in FIG. 24 is constructed similarly to the apparatuses described above. Accordingly, those components of apparatus 18*j* that are the same as, or similar to, those components of those apparatuses described above bear the same part number, but with the addition of the "j" suffix designation.

Apparatus 18*j* includes a pair of foot links 30*aj* and 30*bj* that are supported to cause the foot receiving pedals 27*j* carried thereby to travel about an elliptical path of travel similar to the elliptical paths described above, including paths 181, 182 and 183. To this end, the rearward ends of the foot links 30*aj* and 30*bj* are pinned to flywheels 24*aj* and 24*bj*, in the manner described and shown with respect to FIG. 16. The forward ends of the foot links 30*aj* and 30*bj* are supported by a forward arms 902 and 904. The lower ends of the arms 902 and 904 are coupled to a roller assembly 906 adapted to roll on the top surface of the frame 20*j*, with the frame being wider at its forward location than the width of frame 20 previously described. The upper end of arm 902 is pivotally coupled to the forward end of the foot link at pivot connection 908. The upper end of the arm 904 is also pivotally coupled to the foot links, but a location rearwardly of the pivot connection 908. To this end, a pin 910 is provided for engaging through a through hole formed in the upper end of arm 904 and through a series of transverse through holes 912 formed in the foot links. It would be appreciated that the elevation of the forward end of the foot links may be altered by simply changing the position of the upper end of arm 902 lengthwise along the foot links 30*aj* and 30*bj*.

It will be appreciated that rather than utilizing pins 910 to couple the upper ends of arms 904 to the foot links, such coupling can be accomplished by numerous other methods. For instance, a lead screw assembly or other type of linear actuator may be mounted on the foot links for connection to the arm 904. The use of a linear actuator would enable the location of the upper end of the arm 904 to be adjusted during operation of the apparatus 18*j* rather than having to dismount the apparatus and reposition the arm by removing pin 910 from its current location and placing the pin in a new through hole 912.

It will also be appreciated that rather than adjusting the location of the upper end of arm 904, the upper end of the arm 902 may be adapted to be connected to the foot links at various locations along the length thereof. In this situation, the upper end of the arm 904 may be coupled at a singular location by any convenient means, for instance through a pivot connection similar to pivot connection 908.

Regardless of whether the upper ends of arms 902 or 904, or both, are adapted to be positioned along the length of foot links 30*aj* and 30*bj*, it will be appreciated that by the foregoing construction, the apparatus 18*j* may be adjusted to enable the user to achieve different types of exercise from a gliding or cross-country skiing motion, to a walking motion, to a jogging or running motion to a climbing motion. Thus, the advantages provided by the prior described embodiments are also achieved by apparatus 18*j*.

While preferred embodiments of the present invention have been illustrated and described, it would be appreciated that various changes may be made thereto without departing from the spirit and scope of the present invention.

The embodiments of the invention in which an exclusive property or privilege is claimed are defined as follows:

1. An exercise device to simulate various types of stepping and striding motions, comprising:

a frame defining a rear pivot axis, the frame configured to be supported on a floor;

a first and second foot link, each foot link including a first end portion and a second end portion and a foot support therebetween;

a coupling system associated with the first end portion of each foot link for coupling the first end portion of each foot link to the rear pivot axis so that the first end portion of each foot link travels in a closed path relative to the rear pivot axis;

a guide associated with the frame and operative to engage and direct the second end portions of the foot links along preselected reciprocating paths of travel as the first end portions of the respective foot links travel along their paths of travel, so that when the exercise device is in use and when the second end portion of the foot link travels forwardly from a rearmost position the heel portion of the user's foot initially rises at a faster rate than a toe portion thereof, and when the second end portion of the foot link travels rearwardly, from a foremost position, the heel portion of the user's foot initially lowers at a faster rate than the toe portion, said guide including a roller assembly for rollably supporting the second end portions of the first and second foot links; and a lift mechanism for raising and lowering the roller assembly relative to the rear pivot axis.

2. The exercise device according to claim 1, wherein the roller assembly includes at least one roller having a lateral axis, during use, the axis being held at a stationary location.

3. The exercise device according to claim 1, wherein the frame includes a generally upright post, the roller assembly being connected to the post and supporting the second end portions of the first and second foot links during use.

4. The exercise device according to claim 3, wherein the post includes opposed side surfaces and the roller assembly includes two rollers, one extending from each post side surface.

5. The exercise device according to claim 4, wherein during use the first and second foot links are supported by and roll along the upper surface of the rollers.

6. The exercise device according to claim 3, wherein the roller assembly includes at least one roller movably connected to the upright frame post.

7. The exercise device according to claim 1, wherein the roller assembly is movable relative to the frame by the lift mechanism.

8. The exercise device according to claim 7, wherein the roller assembly is manually movable relative to the frame by the lift mechanism.

9. The exercise device according to claim 3, wherein the lift mechanism includes a lead screw to raise and lower the roller assembly.

10. The exercise device according to claim 9, wherein the lead screw is vertically supported by the post.

11. The exercise device according to claim 10, wherein the lift mechanism includes a slide tube located within the post and rotatably connected to the lead screw, and the roller assembly includes at least one roller connected to the slide tube; the post further including at least one slot, wherein the at least one roller is positioned exterior to the slot during use.

12. The exercise device according to claim 9, wherein the lead screw is manually operable.

13. The exercise device according to claim 12, wherein the lead screw mechanism is manually operable by a hand crank.

14. The exercise device according to claim 7, wherein movement of the lead screw is automated.

15. The exercise device according to claim 1, wherein the frame includes a generally upright post, the roller assembly being connected to the post and supporting the second end portions of the first and second foot links during use; wherein the roller assembly is fixedly attached to the upright frame post.

16. The exercise device according to claim 15, wherein the roller assembly includes at least one roller fixedly attached to the upright frame post.

17. The exercise device according to claim 16, wherein the post includes opposed side surfaces and the roller assembly includes two rollers, one fixedly extending from each post side surface.

18. The exercise device according to claim 16, wherein during use the first and second foot links are supported by and roll along the upper surface of the rollers.

19. The exercise device according to claim 15, wherein the rear pivot axis is supported by a rear post assembly, the rear post assembly being extendable and retractable in the vertical direction.

20. The exercise device according to claim 15, wherein the extension and retraction movement of the rear post assembly is by automated means.

21. An exercise device to simulate various types of stepping and striding motions, comprising:

a frame defining a rear pivot axis, the frame configured to be supported on a floor;

a first and second foot link, each foot link including a first end portion and a second end portion and a foot support therebetween;

a coupling system associated with the first end portion of each foot link for coupling the first end portion of each foot link to the rear pivot axis so that the first end portion of each foot link travels in a closed path relative to the rear pivot axis;

a guide associated with the frame and operative to engage and direct the second end portions of the foot links along preselected reciprocating paths of travel as the first end portions of the respective foot links travel along their paths of travel, so that when the exercise device is in use and when the second end portion of the foot link travels forwardly from a rearmost position the heel portion of the user's foot initially rises at a faster rate than a toe portion thereof, and when the second end portion of the foot link travels rearwardly, from a foremost position, the heel portion of the user's foot initially lowers at a faster rate than the toe portion, said guide including a roller assembly for rollably supporting the second end portions of the first and second foot links; and a lift mechanism for raising and lowering the roller assembly relative to the rear pivot axis;

wherein the frame includes a generally upright post, the roller assembly being connected to the post and supporting the second end portions of the first and second foot links during use;

wherein the lift mechanism includes a lead screw to raise and lower the roller assembly;

wherein the lift mechanism includes a slide tube located within the post and rotatably connected to the lead screw; the slide tube extending outwardly through the bottom of the post and moving relative to the post.

22. The exercise device according to claim 21, wherein extension and retraction of the slide tube relative to the post cause the roller assembly to move relative to the rear pivot axis.

23. The exercise device according to claim 21, wherein the post includes opposed side surfaces and the roller assembly includes two rollers, one extending from each post side surface.

24. The exercise device according to claim 23, wherein the two rollers are fixedly attached to the post.

25. The exercise device according to claim 23, wherein during use the first and second foot links are supported by and roll along the upper surface of the rollers.

26. The exercise device according to claim 21, wherein the lift mechanism is manually operable.

* * * * *

UNITED STATES PATENT AND TRADEMARK OFFICE

CERTIFICATE OF CORRECTION

PATENT NO. : 6,749,540 B1
DATED : June 15, 2004
INVENTOR(S) : P. Pasero et al.

It is certified that error appears in the above-identified patent and that said Letters Patent is hereby corrected as shown below:

Title page,
Item [56], References Cited, U.S. PATENT DOCUMENTS, insert in appropriate order:

| | | |
|---|---|---|
| -- 5,830,112 | 11/1998 | Wang et al. |
| 5,279,529 | 1/1994 | Eschenbach |
| 3,316,898 | 5/1967 | Brown |
| 5,242,343 | 9/1993 | Miller |
| 5,823,917 | 10/1998 | Chen |
| 5,857,941 | 1/1999 | Maresh et al. --. |

Item [57], ABSTRACT,
Line 4, "users" should read -- user's --.

Column 1,
Line 20, "exercise had" should read -- exercise have --.

Column 2,
Line 39, "flywheels, to" should read -- flywheels to --.

Column 3,
Line 32, "apparatus, this" should read -- apparatus; this --.
Line 52, "apparatus; and," should read -- apparatus; --.

Column 5,
Line 49, "30*b* pivotally" should ready -- 30*b* are pivotally --.

Column 6,
Line 9, "rollers coincide" should read -- rollers coincides --.
Line 21, "user's" should read -- users --.
Line 22, "particular different" should read -- particular of different --.
Line 22, "in seams." should read -- inseams. --.
Line 62, "138 is rotatably" should read -- 138 rotatably --.

Column 7,
Line 32, "through a eddy" should read -- through an eddy --.

Column 8,
Line 4, "are formed" should read -- is formed --.
Line 28, "one foot pads" should read -- one of the foot pads --.
Lines 49-50, "lift
mechanism 38" should not break.

UNITED STATES PATENT AND TRADEMARK OFFICE

CERTIFICATE OF CORRECTION

PATENT NO. : 6,749,540 B1
DATED : June 15, 2004
INVENTOR(S) : P. Pasero et al.

It is certified that error appears in the above-identified patent and that said Letters Patent is hereby corrected as shown below:

Column 8 (cont'd),
Lines 55-56, do not begin a new paragraph at "The guide 36....".
Line 63, "by 183 in FIG." should read -- by path 183 in FIG. --.

Column 9,
Line 57, "this information is transmitted" should read -- this information transmitted --.

Column 10,
Line 24, "18 bear" should read -- 18 that bear --.
Line 57, "located with" should read -- located within--.

Column 11,
Line 9, "capable or" should read -- capable of --.
Line 42, "30*b* allow" should read -- 30*b* to allow --.
Line 48, "pivot block about" should read -- pivot block --.
Line 55, "appreciated to" should read -- appreciated by --.

Column 12,
Line 45, "generally define" should read -- generally defines --.

Column 13,
Line 2, "18*d* is essentially" should read -- 18*d* are essentially --.
Line 29, "a "e" suffix" should read -- an "e" suffix --.
Line 66, "a "f" " should read -- an "f" --.

Column 14,
Line 58, "an "g" suffix" should read -- a "g" suffix --.

Column 15,
Line 49, "motion to" should read -- motion, to --.
Line 65, "FIG. 23, includes" should read -- FIG. 23 includes --.
Line 66, "reward" should read -- rearward --.

Column 16,
Line 36, "bracing are reinforcements" should read -- bracing or reinforcements --.

UNITED STATES PATENT AND TRADEMARK OFFICE

CERTIFICATE OF CORRECTION

PATENT NO. : 6,749,540 B1
DATED : June 15, 2004
INVENTOR(S) : P. Pasero et al.

It is certified that error appears in the above-identified patent and that said Letters Patent is hereby corrected as shown below:

Column 17,
Line 1, “supported by a forward” should read -- supported by forward --.
Line 8, “but a location” should read -- but at a location --.
Line 42, “motion to” should read -- motion, to --.

Signed and Sealed this

Fifteenth Day of November, 2005

JON W. DUDAS
*Director of the United States Patent and Trademark Office*